US011427960B2

(12) United States Patent
Green et al.

(10) Patent No.: US 11,427,960 B2
(45) Date of Patent: Aug. 30, 2022

(54) BLEACHING TRICHOMES TO REMOVE PROTEINS

(71) Applicant: The Procter & Gamble Company, Cincinnati, OH (US)

(72) Inventors: Phillip Richard Green, Moneta, VA (US); Raul Victorino Nunes, Loveland, OH (US); Nicholas William Geary, Mariemont, OH (US); Khosrow Parviz Mohammadi, Liberty Township, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 1 day.

(21) Appl. No.: 16/452,569

(22) Filed: Jun. 26, 2019

(65) Prior Publication Data

US 2020/0002887 A1 Jan. 2, 2020

Related U.S. Application Data

(60) Provisional application No. 62/691,747, filed on Jun. 29, 2018.

(51) Int. Cl.
*D21C 9/14* (2006.01)
*D21C 9/16* (2006.01)

(52) U.S. Cl.
CPC ..... *D21C 9/166* (2013.01); *D21C 9/14* (2013.01); *D21C 9/163* (2013.01)

(58) Field of Classification Search
CPC ..... D21C 9/14; D21C 9/166
See application file for complete search history.

(56) References Cited

U.S. PATENT DOCUMENTS

| | | | |
|---|---|---|---|
| 3,863,428 | A | 2/1975 | Baxter |
| 3,994,771 | A | 11/1976 | Morgan, Jr. |
| 5,772,847 | A | 6/1998 | Simpson et al. |
| 7,691,472 | B2 | 4/2010 | Vinson et al. |
| 7,811,613 | B2 | 10/2010 | Vinson et al. |
| 8,029,645 | B2 | 10/2011 | Mohammadi |
| 8,056,841 | B2 | 11/2011 | Vinson et al. |
| 8,297,543 | B2 | 10/2012 | Vinson et al. |
| 8,425,722 | B2 | 4/2013 | Mohammadi |
| 8,623,176 | B2 | 1/2014 | Vinson et al. |
| 8,808,501 | B2 | 8/2014 | Vinson et al. |

(Continued)

FOREIGN PATENT DOCUMENTS

| | | |
|---|---|---|
| JP | H04329913 A | 11/1992 |
| WO | WO-2004044320 | 5/2004 |

(Continued)

OTHER PUBLICATIONS

PCT International Search Report dated Feb. 10, 2017—4 pages.

(Continued)

*Primary Examiner* — Jacob T Minskey
(74) *Attorney, Agent, or Firm* — Richard L. Alexander; Andrew J. Mueller

(57) ABSTRACT

A process for bleaching trichome fibers individualized from a trichome source, such as a leaf and/or a stem, is disclosed. The process of bleaching degrades trichome associated protein. Further, the bleaching processes improves the color of the trichomes, exhibiting CIELAB Color values of L* greater than 87 and b* less than 17 and with less than 0.1% protein by weight of molecular weight greater than 3,500 daltons.

16 Claims, 10 Drawing Sheets

(56) References Cited

U.S. PATENT DOCUMENTS

| | | | |
|---|---|---|---|
| 9,011,641 | B2 | 4/2015 | Mohammadi et al. |
| 9,718,065 | B1 | 8/2017 | Cilia |
| 10,227,729 | B2 | 3/2019 | Mohammadi et al. |
| 10,309,057 | B2 | 6/2019 | Mohammadi et al. |
| 10,344,428 | B2 | 7/2019 | Mohammadi et al. |
| 2003/0208859 | A1 | 11/2003 | Neogi |
| 2004/0221975 | A1 | 11/2004 | Kainth et al. |
| 2004/0250969 | A1 | 12/2004 | Luu |
| 2005/0274470 | A1 | 12/2005 | Shannon |
| 2006/0069069 | A1 | 3/2006 | Kajander et al. |
| 2006/0154832 | A1 | 7/2006 | Peltier |
| 2006/0260002 | A1 | 11/2006 | Ronen |
| 2006/0288639 | A1 | 12/2006 | Vinson et al. |
| 2007/0011762 | A1 | 1/2007 | Vinson et al. |
| 2009/0054858 | A1 | 2/2009 | Cheng et al. |
| 2009/0084513 | A1 | 4/2009 | Barnholtz et al. |
| 2010/0239843 | A1 | 9/2010 | Luu et al. |
| 2011/0104419 | A1 | 5/2011 | Barnholtz et al. |
| 2011/0168342 | A1 | 7/2011 | Mohammadi |
| 2011/0226430 | A1 | 9/2011 | Mohammadi |
| 2013/0215995 | A1 | 8/2013 | Mohammadi |
| 2013/0220563 | A1 | 8/2013 | Mohammadi |
| 2014/0083637 | A1 | 3/2014 | Vinson et al. |
| 2014/0138040 | A1 | 5/2014 | Sartini et al. |
| 2014/0141203 | A1 | 5/2014 | Sartini et al. |
| 2015/0094252 | A1 | 4/2015 | Cuyubamba et al. |
| 2015/0176216 | A1 | 6/2015 | Ostendorf et al. |
| 2015/0211186 | A1 | 7/2015 | McNeil et al. |
| 2015/0337496 | A1 | 11/2015 | Lee |
| 2017/0175338 | A1 | 6/2017 | Mohammadi |
| 2018/0007852 | A1 | 1/2018 | Rose |
| 2020/0002886 | A1 | 1/2020 | Green et al. |
| 2020/0002889 | A1 | 1/2020 | Nunes et al. |
| 2020/0002892 | A1 | 1/2020 | Geary et al. |
| 2020/0359852 | A1 | 11/2020 | Mohammadi et al. |

FOREIGN PATENT DOCUMENTS

| | | |
|---|---|---|
| WO | WO-200613 7041 | 12/2006 |
| WO | WO-2009024897 | 2/2009 |
| WO | WO-2011053956 | 5/2011 |

OTHER PUBLICATIONS

PCT International Search Report dated Jul. 20, 2017—6 pages.
PCT International Search Report dated Jul. 20, 2017—5 pages.
All Office Actions U.S. Appl. No. 14/963,278.
All Office Actions U.S. Appl. No. 15/378,430.
All Office Actions U.S. Appl. No. 16/388,986.
All Office Actions U.S. Appl. No. 15/378,627.
All Office Actions U.S. Appl. No. 15/602,187.
All Office Actions U.S. Appl. No. 16/452,659.
All Office Actions U.S. Appl. No. 16/452,574.
All Office Actions U.S. Appl. No. 16/452,579.
All Office Actions U.S. Appl. No. 16/452,582.
Documentation for ImageJ software, National Institute of Health, 3 pages, 2007, online], retrieved from the Internet, [retrieved Jan. 8, 2017], URL:https://imagej.nih.gov/ij/index.html.
James Mauseth, Botany, Oct. 25, 2019, Jones and Bartlett Learning, p. 76 (Year: 2019).
Zhang, et al., "A Simple and Efficient Method for Isolating Trichomes for Downstream Analyses", Plant and Cell Phys., vol. 45, No. 2, pp. 221-224. (Year: 2004).
U.S. Appl. No. 16/388,986, filed Apr. 19, 2019, Khosrow Parviz Mohammadi, et al.
U.S. Appl. No. 15/378,627, filed Dec. 14, 2016, Khosrow Parviz Mohammadi, et al.
U.S. Appl. No. 16/452,574, filed Jun. 26, 2019, Phillip Richard Green, et al.
U.S. Appl. No. 16/452,579, filed Jun. 26, 2019, Phillip Richard Green, et al.
U.S. Appl. No. 16/452,582, filed Jun. 26, 2019, Nicholas William Geary, et al.
All Office Actions; U.S. Appl. No. 17/382,725, filed Jul. 22, 2021.
All Office Actions; U.S. Appl. No. 17/510,434, filed Oct. 26, 2021.
Daher et al., "How to let go: pectin and plant cell adhesion", Frontiers in Plant Science, vol. 6, Article 523, pp. 1-8, Jul. 14, 2015.
Martins et al., "Purification and Properties of Polygalacturonase Produced by Thermophilic Fungus Thermoascus aurantiacus CBMAI-756 on Solid-State Fermentation", Enzyme Research, vol. 13, Article 438645, pp. 1-7, 2013.
U.S. Appl. No. 17/382,725, filed Jul. 22, 2021; to first inventor Khosrow Parviz Mohammadi et. al.
U.S. Appl. No. 17/510,434, filed Oct. 26, 2021, to first inventor et. al.

A. pH 2.0, 40°C, 16h
B. pH 2.0, 60°C, 8h
C. pH 2.0, Acid Pump, no buffer, 40°C, 16h
D. pH 2.0, 70°C, 4h
E. pH 2.0, 80°C, 4h
F. NaChlorite 0.4g/g at pH 2.0
G. NaChlorite at 0.3g/g followed by 0.3g/g TAED
H. MCPB at 0.4g/g and pH 8.4

BLEACHING TRICHOMES TO REMOVE PROTEINS

FIELD OF THE INVENTION

The present invention relates to processes for bleaching trichome fibers individualized from a trichome source, such as a leaf and/or a stem. Specifically, it relates to a method of bleaching that degrades trichome associated protein.

BACKGROUND OF THE INVENTION

The interest in using non-wood materials, such as trichomes and bamboo fibers, to make fibrous structures, for example sanitary tissue products, has recently increased in light of the continuing efforts relating to sustainability.

One non-wood material that shows promise as a replacement or partial replacement of wood pulp fibers in fibrous structures, such as sanitary tissue products, is trichomes; namely, individualized trichome fibers obtained from plants, such as *Stachys byzantina* plants, for example Lamb's Ear plants. However, "clean" individualized trichome fibers are challenging to obtain in large amounts due to the impurities, such as stems, specks, dirt, clay, sand, and other non-trichome materials may be present with the individualized trichome fibers as a result of the processes for harvesting the plants and extracting the individualized trichome fibers from the plants. These impurities find their way into fibrous structures made with the individualized trichome fibers and result in the fibrous structures looking dirty and filled with specks that render the fibrous structures unacceptable to consumers of the fibrous structures.

Known processes for individualizing (separating) trichome fibers from plants include mechanical cutting and air sorting operations, chemical and enzymatic reactions. Such processes yield individualized trichome fibers still containing a level of color and/or non-trichome materials, for example specks, that is not consumer acceptable. They also contain variable amounts of proteins, many of which have a molecular weight of at least 2,500 daltons. These proteins pose a human allergenicity risk in the manufacturing of consumer goods containing trichomes. This risk may be quantified using tests that may add 2-3 years to a consumer product commercialization, and dealing with the industrial hygiene risk may add significant costs to the manufacturing of consumer goods containing trichomes.

Accordingly, there is a need for process to treat individualized trichome fibers to improve the color and remove or to lighten specks so as to be unnoticeable to the consumer, and degrade the protein, such that the treated individualized trichome fibers can be used to make consumer desirable fibrous structures, such as sanitary tissue products.

SUMMARY OF THE INVENTION

The present invention fulfills the need described above by providing a commercially viable process for reacting trichome fibers from a trichome source with bleaching chemicals to lighten the trichome color, lighten the color of the specks so as to make them unobservable by a consumer, and degrade high molecular weight proteins to a level that removes allergenicity concerns.

In one example, both dithionite and N,N,N',N'-Tetraacetylethylenediamine (TAED) plus hydrogen peroxide were demonstrated to lighten the color of individualized trichomes. In another example, sodium chlorite was demonstrated to lighten the color of individualized trichomes. In another example, sodium chlorite plus hydrogen peroxide was demonstrated to lighten the color of individualized trichomes.

In another example, peracetic acid was demonstrated to lighten the color of individualized trichomes. In another example, m-Chloroperoxybenzoic Acid (MCPB) was demonstrated to lighten the color of individualized trichomes. In another example, a two-step bleaching process in which sodium chlorite was reacted with the individualized trichomes, followed by a reaction with TAED plus hydrogen peroxide, which lightened the individualized trichomes to a greater extent than with each bleaching agent alone and while reacted for a shorter time.

In another example, a two-step bleaching process in which sodium chlorite plus hydrogen peroxide were reacted with the individualized trichomes, followed by a reaction with TAED plus hydrogen peroxide, which lightened the individualized trichomes to a greater extent than with each bleaching agent alone and while reacted for a shorter time.

In another example, a two-step bleaching process in which sodium chlorite was reacted with the individualized trichomes, followed by a reaction with peracetic acid, which lightened the individualized trichomes to a greater extent than with each bleaching agent alone and while reacted for a shorter time.

In another example, a two-step bleaching process in which sodium chlorite plus hydrogen peroxide were reacted with the individualized trichomes, followed by a reaction with peracetic acid, which lightened the individualized trichomes to a greater extent than with each bleaching agent alone and while reacted for a shorter time.

In another example, a two-step bleaching process in which sodium chlorite was reacted with the individualized trichomes, followed by a reaction with MCPB, which lightened the individualized trichomes to a greater extent than with each bleaching agent alone and while reacted for a shorter time.

In another example, a two-step bleaching process in which sodium chlorite plus hydrogen peroxide were reacted with the individualized trichomes, followed by a reaction with MCPB, which lightened the individualized trichomes to a greater extent than with each bleaching agent alone and while reacted for a shorter time.

In another example, TAED plus hydrogen peroxide was demonstrated to degrade high molecular proteins associated with the individualized trichomes. In another example, peracetic acid was demonstrated to degrade high molecular proteins associated with the individualized trichomes. In another example, MCPB was demonstrated to degrade high and low molecular proteins associated with the individualized trichomes.

In yet another example of the present invention, a fibrous structure, for example a single- or multi-ply sanitary tissue product, such as a toilet tissue, paper towels, facial tissue, wipes, comprising individualized trichomes from the process of the present invention is provided.

The present invention provides a novel process for bleaching trichomes and fibrous structures made from such trichomes.

DETAILED DESCRIPTION OF THE INVENTION

Definitions

Figure 1:
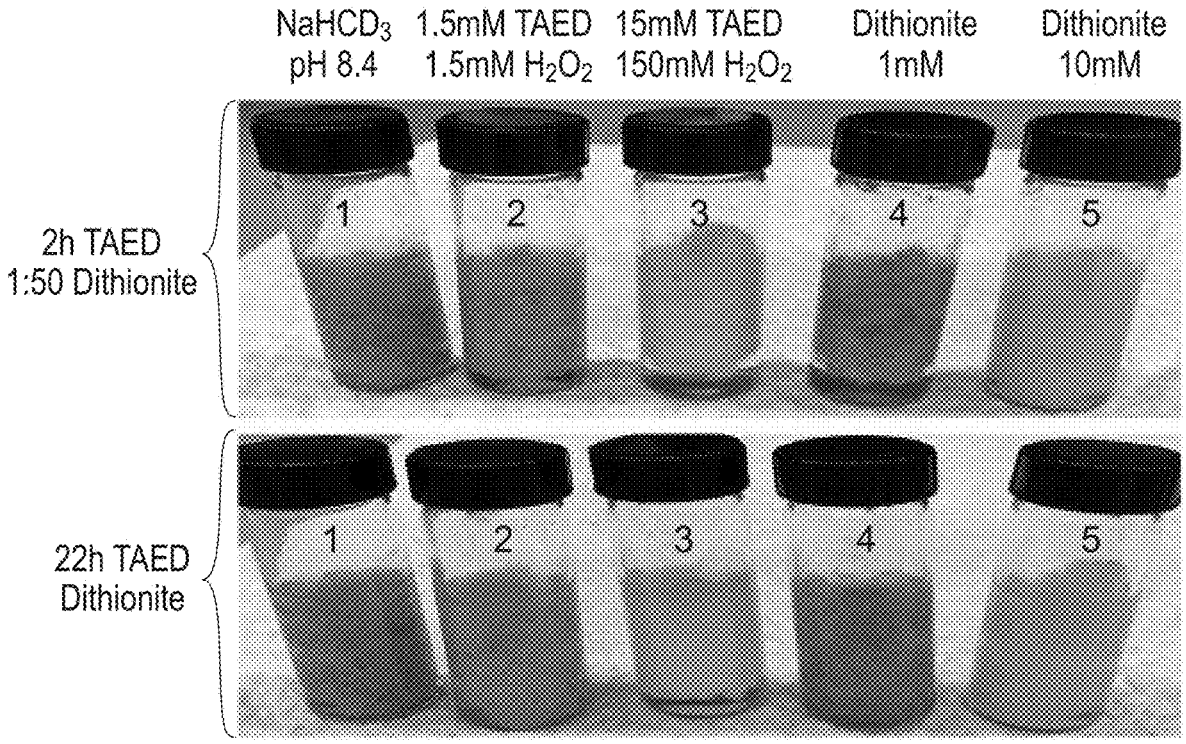
FIG. 1 is a photograph of trichomes in vials after reacting with dithionite or TAED plus hydrogen peroxide for 1 h 50 min/2 h or for 22 h.

"Biomass" as used herein is plant derived material which includes leaves, stems and bracts that exhibit attached trichomes. The plant derived material may be freshly cut or freshly cut and frozen or refrigerated and contain at least 50% water, or at least 60% water, or at least 70% water, or at least 80% water, or at least 90% water by weight. The plant derived material may be dried and contain less than 50% water, or less than 40% water, or less than 30% water, or less than 20% water, or less than 10% water by weight. The biomass may also contain less than 5% by weight of non-trichome containing plant material from non-target plants that are harvested along with the trichome containing plant material.

"Bleach" or "Bleach Reactant" as used herein is a chemical that, when contacted with individualized trichomes, reacts with and oxidizes or reduces trichome associated components, causing a desired change in color to the individualized trichome. This desired change in color is generally exhibited by an increase in the CIELAB color component L* to varying degrees depending on the bleach and on the reaction conditions including amount of bleach, time of reaction and temperature of reaction. Changes to the a* and b* color components may also occur. Examples of oxidizing bleach reactants include, but are not limited to, sodium chlorite, chlorine dioxide, hypochlorous acid, hydrogen peroxide, organic and inorganic peracids such as peracetic acid, percarbonate, perborate, potassium monopersulfate and m-chloroperoxybenzoic acid (MCPB). An examples of reducing bleach reactants include, but are not limited to, sodium dithionite and sodium borohydride.

"CIELAB" (CIE L*a*b*) (Lab Color Space—From Wikipedia, the free encyclopedia) is a color space specified by the International Commission on Illumination (French *Commission internationale de l'éclairage*, hence the CIE initialism). It describes all the colors visible to the human eye and was created to serve as a device-independent model to be used as a reference.

The three coordinates of CIELAB represent the lightness of the color (L*=0 yields black and L*=100 indicates diffuse white; specular white may be higher), its position between red/magenta and green (a*, negative values indicate green while positive values indicate magenta) and its position between yellow and blue (b*, negative values indicate blue and positive values indicate yellow). The asterisk (*) after L, a and b are pronounced star and are part of the full name, since they represent L*, a* and b*, to distinguish them from Hunter's L, a, and b.

Since the L*a*b* model is a three-dimensional model, it can be represented properly only in a three-dimensional space. Two-dimensional depictions include chromaticity diagrams: sections of the solid with a fixed lightness. It is crucial to realize that the visual representations of the full gamut of colors in this model are never accurate; they are there just to help in understanding the concept.

Because the red-green and yellow-blue opponent channels are computed as differences of lightness transformations of (putative) cone responses, CIELAB is a chromatic value color space.

"Contacting" as used herein means any situation wherein one component has access to another component. Thus, when biomass is contacted with an enzyme, the enzyme has access to the biomass such that it catalyzes a reaction with the biomass. This could occur in a suspension of biomass in an aqueous milieu, but could also occur if a solution containing dissolved enzyme is sprayed onto the biomass. When bleach reactants contact trichomes, the bleach reactant has access to the trichomes such that they react with the components of the trichome. This could occur in a suspension of the trichomes in an aqueous milieu, but could also occur if a solution containing a bleach reactant is sprayed onto trichomes, or for some bleach reactants, added as a vapor or in the gas phase to trichomes.

"Enzymes" as used herein are proteinaceous molecules capable of catalyzing a chemical reaction. An enzyme may be naturally occurring and utilized as is, or it can be artificially modified in its amino acid sequence or through chemical reactions to improve the catalytic performance for the specific application. An enzyme as used herein may also be comprised of more than one identifiable protein sequence, i.e., a mixture containing more than one enzyme.

"Trichome" as used herein means an epidermal attachment of a varying shape, structure and/or function of a non-seed portion of a plant. In one example, a trichome is an outgrowth of the epidermis of a non-seed portion of a plant. The outgrowth may extend from an epidermal cell. In one embodiment, the outgrowth is a trichome fiber. The outgrowth may be a hairlike or bristlelike outgrowth from the epidermis of a plant. Trichomes may protect the plant tissues present on a plant. Trichomes may for example protect leaves and stems from attack by other organisms, particularly insects or other foraging animals and/or they may regulate light and/or temperature and/or moisture. They may also produce glands in the forms of scales, different papills and, in roots, often they may function to absorb water and/or moisture. A trichome may be formed by one cell or many cells. The term "individualized trichome" as used herein means trichomes which have been artificially separated by a suitable method for individualizing trichomes from their host plant. In other words, individualized trichomes as used herein means that the trichomes become separated from a non-seed portion of a host plant by some non-naturally occurring action. In one example, individualized trichomes are artificially separated in a location that is sheltered from nature. Primarily, individualized trichomes will be fragments or entire trichomes with essentially no remnant of the host plant attached. However, individualized trichomes can also comprise a minor fraction of trichomes retaining a portion of the host plant still attached, as well as a minor fraction of trichomes in the form of a plurality of trichomes bound by their individual attachment to a common remnant of the host plant. Individualized trichomes may comprise a portion of a pulp or mass further comprising other materials. Other materials includes nontrichome-bearing fragments of the host plant. In one example of the present invention, the individualized trichomes may be classified to enrich the individualized trichomal content at the expense of mass not constituting individualized trichomes. Individualized trichomes may be converted into chemical derivatives including but not limited to cellulose derivatives, for example, regenerated cellulose such as rayon; cellulose ethers such as methyl cellulose, carboxymethyl cellulose, and hydroxyethyl cellulose; cellulose esters such as cellulose acetate and cellulose butyrate; and nitrocellulose. Individualized trichomes may also be used in their physical form, usually fibrous, and herein referred to "trichome fibers", as a component of fibrous structures.

Trichome fibers are different from seed hair fibers in that they are not attached to seed portions of a plant. For example, trichome fibers, unlike seed hair fibers, are not attached to a seed or a seed pod epidermis. Cotton, kapok, milkweed, and coconut coir are nonlimiting examples of seed hair fibers. Further, trichome fibers are different from nonwood bast and/or core fibers in that they are not attached to the bast, also known as phloem, or the core, also known as xylem portions of a nonwood dicotyledonous plant stem. Nonlimiting examples of plants which have been used to yield nonwood bast fibers and/or nonwood core fibers include kenaf, jute, flax, ramie and hemp. Further trichome fibers are different from monocotyledonous plant derived fibers such as those derived from cereal straws (wheat, rye, barley, oat, etc), stalks (corn, cotton, sorghum, *Hesperaloe funifera*, etc.), canes (bamboo, bagasse, etc.), grasses (esparto, lemon, sabai, switchgrass, etc), since such monocotyledonous plant derived fibers are not attached to an epidermis of a plant. Further, trichome fibers are different from leaf fibers in that they do not originate from within the leaf structure. Sisal and abaca are sometimes liberated as leaf fibers. Finally, trichome fibers are different from wood pulp fibers since wood pulp fibers are not outgrowths from the epidermis of a plant; namely, a tree. Wood pulp fibers rather originate from the secondary xylem portion of the tree stem.

In one example, the trichome fibers of the present invention are individualized from plants in the following families: Labiatae (Lamiaceae), Asteraceae, Scrophulariaceae, Greyiaceae, Fabaceae, Solanaceae, Convolvulaceae, Malvaceae, Loganiaceae, Rutaceae, Rhamnaceae, Geraniaceae, Melastomataceae, Bromeliaceae, Hypericaceae, Polygonaceae, Euphorbiaceae, Crassulaceae, Poaceae, Verbenaceae, and mixtures thereof.

In another example, the trichome fibers of the present invention are individualized from plants in the Labiatae (Lamiaceae) family, for example from one or more *Stachys byzantine* plants, more particularly, the *Stachys lanata* (commonly referred to as lamb's ear) plant.

"Fiber" as used herein means an elongate physical structure having an apparent length greatly exceeding its apparent diameter, i.e. a length to diameter ratio of at least about 10. Fibers having a non-circular cross-section and/or tubular shape are common; the "diameter" in this case may be considered to be the diameter of a circle having cross-sectional area equal to the cross-sectional area of the fiber. More specifically, as used herein, "fiber" refers to fibrous structure-making fibers. The present invention contemplates the use of a variety of fibrous structure-making fibers, such as, for example, natural fibers, such as trichome fibers and/or wood pulp fibers, or synthetic fibers, or any other suitable fibers, and any combination thereof.

"Fiber Length", "Average Fiber Length" and "Weighted Average Fiber Length", are terms used interchangeably herein all intended to represent the "Length Weighted Average Fiber Length" as determined for example by means of a Valmet Fiber Image Analyzer—Valmet FS5 commercially available from Valmet, Espoo, Finland. The instructions in the Owner's Manual K12690 V1.2 EN supplied with the unit detail the formula used to arrive at this average. The recommended method for measuring fiber length using this instrument is essentially the same as detailed by the manufacturer in its owner's manual. The recommended consistencies for charging to the FiberLab are somewhat lower than recommended by the manufacturer since this gives more reliable operation. Short fiber furnishes, as defined herein, should be diluted to 0.02-0.04% prior to charging to the instrument. Long fiber furnishes, as defined herein, should be diluted to 0.15%-0.30%. Alternatively, fiber length may be determined by sending the short fibers to a contract lab, such as Integrated Paper Services, Appleton, Wis.

Fibrous structures may be comprised of a combination of long fibers and short fibers. Non-limiting examples of suitable long fibers for use in the present invention include fibers that exhibit an average fiber length of less than about 7 mm and/or less than about 5 mm and/or less than about 3 mm and/or less than about 2.5 mm and/or from about 1 mm to about 5 mm and/or from about 1.5 mm to about 3 mm and/or from about 1.8 mm to about 4 mm and/or from about 2 mm to about 3 mm.

Non-limiting examples of suitable short fibers suitable for use in the present invention include fibers that exhibit an average fiber length of less than about 5 mm and/or less than about 3 mm and/or less than about 1.2 mm and/or less than about 1.0 mm and/or from about 0.4 mm to about 5 mm and/or from about 0.5 mm to about 3 mm and/or from about 0.5 mm to about 1.2 mm and/or from about 0.6 mm to about 1.0 mm.

The individualized trichomes used in the present invention may include trichome fibers. The trichome fibers may be characterized as either long fibers or short fibers.

"Sifting" as used herein means a process that separates and retains coarse parts with a sieve and/or screen allowing less coarse parts to pass through the sieve and/or screen.

"Consumer Product" as used herein is typically disposable product used for a variety of personal and household care applications. These include, but are not limited to sanitary tissues, paper towels, catamenials, diapers, wipes, personal cleansing and hygiene such as shampoo, antiperspirants, deodorants and hair removal, and household products such as laundry detergents, dishwashing detergents and deodorizers.

"Pulping" as used herein refers to the wet chemical processes applied used to liberate cellulosic fibers from biomass, typically wood, fiber crops and paper. One type of wet chemical pulping is the Kraft Process which utilizes sodium sulfite, alkali and 170-176° C. water in the reaction. Another type of wet chemical pulping is the Soda Process which utilizes limewater, soda crystals and 178.9° C. water in the reaction. Another type of wet chemical pulping is the sulfite process which utilizes salts of sulfurous acid at pH 1.5-5 and water at 130-160° C. in the reaction.

Source of Trichomes

One embodiment of the present invention involves choosing a plant source of trichomes. Essentially all plants have trichomes. Those skilled in the art will recognize that some plants will have trichomes of sufficient mass fraction and/or the overall growth rate and/or robustness of the plant so that they may offer attractive agricultural economy to make them more suitable for a large commercial process, such as using them as a source of chemicals, e.g. cellulose, or assembling them into fibrous structures, such as disposable fibrous structures.

Trichomes may have a wide range of morphology and chemical properties. For example, the trichomes may be in the form of fibers; namely, trichome fibers. Such trichome fibers may have a high length to diameter ratio.

The following sources are offered as non-limiting examples of trichome-bearing plants (suitable sources) for obtaining trichomes, especially trichome fibers.

Non-limiting examples of suitable sources for obtaining trichomes, especially trichome fibers, are plants in the Labiatae (Lamiaceae) family commonly referred to as the mint family. Examples of suitable species in the Labiatae family include *Stachys byzantina*, also known as *Stachys lanata* commonly referred to as lamb's ear, woolly betony, or woundwort. The term *Stachys byzantina* as used herein also includes cultivars *Stachys byzantina* 'Primrose Heron', *Stachys byzantina* 'Helene von Stein' (sometimes referred to as *Stachys byzantina* 'Big Ears'), *Stachys byzantina* 'Cotton Boll', *Stachys byzantina* 'Variegated' (sometimes referred to as *Stachys byzantina* 'Striped Phantom'), and *Stachys byzantina* 'Silver Carpet'.

Additional examples of suitable species in the Labiatae family include the *arcticus* 30 subspecies of *Thymus praecox*, commonly referred to as creeping thyme and the *pseudolanuginosus* subspecies of *Thymus praecox*, commonly referred to as wooly thyme. Further examples of suitable species in the Labiatae family include several species in the genus *Salvia* (sage), including *Salvia leucantha*, commonly referred to as the Mexican bush sage; *Salvia tarahumara*, commonly referred to as the grape scented Indian sage; *Salvia apiana*, commonly referred to as white sage; *Salvia funereal*, commonly referred to as Death Valley sage; *Salvia sagittata*, commonly referred to as balsamic sage; and *Salvia argentiae*, commonly referred to as silver sage.

Even further examples of suitable 5 species in the Labiatae family include *Lavandula lanata*, commonly referred to as wooly lavender; *Marrubium vulgare*, commonly referred to as horehound; *Plectranthus argentatus*, commonly referred to as silver shield; and *Plectranthus tomentosa.*

Non-limiting examples of other suitable sources for obtaining trichomes, especially trichome fibers are plants in the Asteraceae family commonly referred to as the sunflower family. Examples of suitable species in the Asteraceae family include *Artemisia stelleriana*, also known as silver brocade; *Haplopappus macronema*, also known as the whitestem goldenbush; *Helichrysum petiolare; Centaurea maritime*, also known as *Centaurea gymnocarpa* or dusty miller; *Achillea tomentosum*, also known as wooly yarrow; *Anaphalis margaritacea*, also known as pearly everlasting; and *Encelia farinose*, also known as brittle bush.

Additional examples of suitable species in the Asteraceae family include *Senecio brachyglottis* and *Senecio haworthii*, the latter also known as *Kleinia haworthii.*

Non-limiting examples of other suitable sources for obtaining trichomes, especially trichome fibers, are plants in the Scrophulariaceae family commonly referred to as the figwort or snapdragon family. An example of a suitable species in the Scrophulariaceae family includes *Pedicularis kanei*, also known as the wooly lousewort. Additional examples of suitable species in the Scrophulariaceae family include the mullein species (*Verbascum*) such as *Verbascum hybridium*, also known as snow maiden; *Verbascum thapsus*, also known as common mullein; *Verbascum baldaccii; Verbascum bombyciferum; Verbascum broussa; Verbascum chaixii; Verbascum dumulsum; Verbascum laciniatum; Verbascum lanatum; Verbascum longifolium; Verbascum lychnitis; Verbascum olympicum; Verbascum paniculatum; Verbascum phlomoides; Verbascum phoeniceum; Verbascum speciosum; Verbascum thapsiforme; Verbascum virgatum; Verbascum wiedemannianum*; and various mullein hybrids including *Verbascum* 'Helen Johnson' and *Verbascum* 'Jackie'.

Further examples of suitable species in the Scrophulariaceae family include *Stemodia tomentosa* and *Stemodia durantifolia.*

Non-limiting examples of other suitable sources for obtaining trichomes, especially trichome fibers include *Greyia radlkoferi* and *Greyia flanmaganii* plants in the Greyiaceae family commonly referred to as the wild bottlebrush family.

Non-limiting examples of other suitable sources for obtaining trichomes, especially trichome fibers include members of the Fabaceae (legume) family. These include the *Glycine max*, commonly referred to as the soybean, and *Trifolium pratense* L, commonly referred to as medium and/or mammoth red clover.

Non-limiting examples of other suitable sources for obtaining trichomes, especially trichome fibers include members of the Solanaceae family including varieties of *Lycopersicum esculentum*, otherwise known as the common tomato.

Non-limiting examples of other suitable sources for obtaining trichomes, especially trichome fibers include members of the Convolvulaceae (morning glory) family, including *Argyreia nervosa*, commonly referred to as the wooly morning glory and *Convolvulus cneorum*, commonly referred to as the bush morning glory.

Non-limiting examples of other suitable sources for obtaining trichomes, especially trichome fibers include members of the Malvaceae (mallow) family, including *Anoda cristata*, commonly referred to as spurred *anoda* and *Abutilon theophrasti*, commonly referred to as velvet leaf.

Non-limiting examples of other suitable sources for obtaining trichomes, especially trichome fibers include *Buddleia marrubiifolia*, commonly referred to as the wooly butterfly bush of the Loganiaceae family; the *Casimiroa tetrameria*, commonly referred to as the wooly leafed sapote of the Rutaceae family; the *Ceanothus tomentosus*, commonly referred to as the wooly leafed mountain liliac of the Rhamnaceae family; the 'Philippe Vapelle' cultivar of renardii in the Geraniaceae (geranium) family; the *Tibouchina urvilleana*, commonly referred to as the Brazilian spider flower of the Melastomataceae family; the *Tillandsia recurvata*, commonly referred to as ballmoss of the Bromeliaceae (pineapple) family; the *Hypericum tomentosum*, commonly referred to as the wooly St. John's wort of the Hypericaceae family; the 30 *Chorizanthe orcuttiana*, commonly referred to as the San Diego spineflower of the Polygonaceae family; *Eremocarpus setigerus*, commonly referred to as the doveweed of the Euphorbiaceae or spurge family; *Kalanchoe tomentosa*, commonly referred to as the panda plant of the Crassulaceae family; and *Cynodon dactylon*, commonly referred to as Bermuda grass, of the Poaceae family; and *Congea tomentosa*, commonly referred to as the shower orchid, of the Verbenaceae family.

Suitable trichome-bearing plants are commercially available from nurseries and other plant-selling commercial venues. For example, *Stachys byzantina* may be purchased and/or viewed at Blanchette Gardens, Carlisle, Mass.

In another aspect of the invention, trichome sources are processes to yield individualized trichomes which are the materials to be bleached. Suitable processes may include, but are not limited to, mechanical processes, chemical processes or enzymatic processes.

Mechanical processes for individualizing (separating) trichome fibers from plants typically utilize mechanical cutting and air sorting operations. Such operations are very costly, require high amounts of maintenance, are normally batch processes rather than continuous processes, and the individualized trichome fibers still contain a level of non-trichome materials, for example specks, sand, stems, that is not consumer acceptable.

A chemical process is known which requires reacting the trichome source plant material with 1%-10% chelating agent and 0.01%-5.0% surfactant at high temperature and pressure at an alkaline pH, followed by shear mixing. Another chemical process is known which requires reaction the trichome source plant material with acid at a pH less than 5 to degrade the leaves and release the trichomes.

An enzymatic process is known which requires reacting the trichome source plant material with Pectinase enzymes to release trichomes from stems, and to degrade the leaves and release the trichomes.

Other laboratory scale processes for isolating trichome fibers from trichome sources are known in the art. For example, benchtop scale chemical separation processes for removing trichomes, for example *Arabidopsis* trichomes from the Brassicaceae family, from trichome sources are known. Such a known benchtop scale chemical separation process utilizes a mixture of a chelating agent, such as ethylene glycol bis-(β-aminoethyl ether)-N,N,N',N'-tetraacetic acid ("EGTA") and a nonionic surfactant, such as Triton X-100. The process incubates the trichome source in a mixture of EGTA and Triton X-100 at 4° C. for 16-24 hours and/or at 50° C. for 1 hour followed by gentle rubbing using an artist's paintbrush. Such as process is not commercially feasible on a large scale commercial process.

In another aspect, individualized trichomes are subjected to bleaching to lighten them. Individualized trichomes recovered from the various process described and incorporated into a consumer product may not exhibit the color characteristics acceptable to most consumers. For example, consumers prefer a very light or white colored toilet tissue. This is similar to the processing of natural fibers such as pulp or cotton, which have a long history of bleach process development. Bleach reactants and reaction conditions should be chosen to minimize oxidative damage to the cellulose in the trichome. For example, sodium chlorite is an advantageous bleach reactant to use because bleaching conditions can be specified which no measurable oxidative damage to cellulosic fibers. For reference, see J. K. Skelly, The Journal of the Society of Dyers and Colourists Vol. 76(8) (1960) pg. 469-479; M. Lewin, Ch. 2 in The Handbook of Fiber Science and Technology: Volume 1, Chemical Processing of Fibers and Fabrics, Fundamentals and Preparation, Part B, Menachim Lewin and Stephen B. Sello, ed. A hydrophobic lipid fraction such as waxes are often associated with natural fibers like trichomes and cotton. There may be a need to limit hydrophobe removal. Some bleach steps, such as scouring, are used to remove the waxes and make the fiber hydrophilic and able to easily absorb water. Other bleach steps are used to whiten the fiber, and may remove hydrophobic fractions. Sodium chlorite bleaching only incompletely removes the waxes. Chlorite is effective at bleaching cotton seed husks, which may be similar to the specks observed in individualized trichome preparations. Furthermore, addition of hydrogen peroxide reduces the conversion of chlorite to chlorine dioxide, which is not a preferred bleaching agent in these reactions.

Hydrogen peroxide activators can be used to bleach materials. Alkali activates hydrogen peroxide, but more efficient bleaching can be achieved by conversion into peracids. Peracid bleaching is often used alone or in combination with other bleaching steps. One example of an activator is N,N,N',N'-Tetraacetylethylenediamine (TAED) which reacts with two hydrogen peroxide molecules to release two peracetic acid molecules. Peracetic acid has an advantage over chlorite and hydrogen peroxide as it causes less swelling to cellulose, but it does not bleach e.g., cottonseed husks. Cotton bleach processes utilizing TAED or peracetic acid directly have been reported (RJTA 17(1): 94-103 2013; Indian J. of Fibre and Textile Research 29: 343-349 2004; Carbohydrate Polymers 86: 988-994 2011). Other organic and inorganic peracids such as peracetic acid, percarbonate, perborate, potassium monopersulfate and m-chloroperoxybenzoic acid (MCPB) may be used to bleach fibers.

In another aspect, individualized trichomes are subjected to reactions, such as oxidation, that degrade proteins associated with them. It is well known that biological systems are continually exposed to endogenous and exogenous oxidants and that proteins are major targets for radicals and two-electron oxidants (Biochemical Journal 473: 805-825 2016). For example, hydroxyl radicals formed from metal ion-catalyzed decomposition of hydrogen peroxide can react with all protein residues. Organic peracids especially react with cysteine, methionine, tryptophan an, tyrosine and histidine residues in protein. Hydroperoxide products of amino acids can be formed and can cause further oxidative damage. Damage occurs at multiple side-chain and backbone sites, and this can result in modifications which includes side-chain and backbone fragmentation. A study on hypochlorous acid and peracetic acid oxidation of whey and casein protein was reported in the Journal of Agricultural and Food Chemistry 59: 907-914 2011. At the 0-6.6 mmol oxidant/g protein concentrations described in the reference, amino acid analysis and SDS-PAGE gel analysis indicates that hypochlorous acid quickly oxidizes sensitive amino acids such as tryptophan and methionine, but appears to cause aggregation of the proteins, followed by precipitation. Peracetic acid oxidation exhibited minimal protein degradation.

The presence of allergenic proteins can lead to higher costs to accommodate industrial hygiene issues, and there are potential human safety issues. Surprisingly, the present invention has found that oxidation reactions may be used to nearly completely degrade high molecular weight protein, as measured by SDS-PAGE analysis, in the material or product and minimize cost and safety issues.

In another aspect, trichomes are suspended with mixing in an aqueous solution, the solution is adjusted to an optimal pH and temperature, sodium chlorite is added and allowed to react until the trichomes and the specks are reacted. The bleached trichomes may be recovered from the suspension.

In another aspect, trichomes are suspended with mixing in an aqueous solution, the solution is adjusted to an optimal pH and temperature, sodium chlorite and hydrogen peroxide are added and allowed to react until the trichomes and the specks are reacted. The bleached trichomes may be recovered from the suspension.

In another aspect, trichomes are suspended with mixing in an aqueous solution, the solution is adjusted to an optimal pH and temperature, TAED and hydrogen peroxide are added and allowed to react until the trichomes and the specks are reacted. The bleached trichomes may be recovered from the suspension.

In another aspect, trichomes are suspended with mixing in an aqueous solution, the solution is adjusted to an optimal pH and temperature, peracetic acid is added and allowed to react until the trichomes and the specks are reacted. The bleached trichomes may be recovered from the suspension.

In another aspect, trichomes are suspended with mixing in an aqueous solution, the solution is adjusted to an optimal pH and temperature, sodium chlorite is added and allowed to react until the trichomes and the specks are reacted. The pH and temperature are further adjusted and a second bleaching reaction is run by adding TAED and hydrogen peroxide and allowed to react until the trichomes and the specks are further reacted. The bleached trichomes may be recovered from the suspension.

In another aspect, trichomes are suspended with mixing in an aqueous solution, the solution is adjusted to an optimal pH and temperature, sodium chlorite and hydrogen peroxide are added and allowed to react until the trichomes and the specks are reacted. The pH and temperature are further adjusted and a second bleaching reaction is run by adding TAED and hydrogen peroxide and allowed to react until the trichomes and the specks are further reacted. The bleached trichomes may be recovered from the suspension.

In another aspect, trichomes are suspended with mixing in an aqueous solution, the solution is adjusted to an optimal pH and temperature, sodium chlorite is added and allowed to react until the trichomes and the specks are reacted. The pH and temperature are further adjusted and a second bleaching reaction is run by adding peracetic acid and allowed to react until the trichomes and the specks are further reacted. The bleached trichomes may be recovered from the suspension.

In another aspect, trichomes are suspended with mixing in an aqueous solution, the solution is adjusted to an optimal pH and temperature, sodium chlorite and hydrogen peroxide are added and allowed to react until the trichomes and the specks are reacted. The pH and temperature are further adjusted and a second bleaching reaction is run by adding peracetic acid and allowed to react until the trichomes and the specks are further reacted. The bleached trichomes may be recovered from the suspension.

In another aspect, trichomes are suspended with mixing in an aqueous solution, the solution is adjusted to an optimal pH and temperature, TAED and hydrogen peroxide are added and allowed to react until the trichomes and the specks are reacted. The pH and temperature are further adjusted and a second bleaching reaction is run by adding sodium chlorite and allowed to react until the trichomes and the specks are further reacted. The bleached trichomes may be recovered from the suspension.

In another aspect, trichomes are suspended with mixing in an aqueous solution, the solution is adjusted to an optimal pH and temperature, TAED and hydrogen peroxide are added and allowed to react until the trichomes and the specks are reacted. The pH and temperature are further adjusted and a second bleaching reaction is run by adding sodium chlorite plus hydrogen peroxide and allowed to react until the trichomes and the specks are further reacted. The bleached trichomes may be recovered from the suspension.

In another aspect, trichomes are suspended with mixing in an aqueous solution, the solution is adjusted to an optimal pH and temperature, peracetic acid is added and allowed to react until the trichomes and the specks are reacted. The pH and temperature are further adjusted and a second bleaching reaction is run by adding sodium chlorite and allowed to react until the trichomes and the specks are further reacted. The bleached trichomes may be recovered from the suspension.

In another aspect, trichomes are suspended with mixing in an aqueous solution, the solution is adjusted to an optimal pH and temperature, peracetic acid is added and allowed to react until the trichomes and the specks are reacted. The pH and temperature are further adjusted and a second bleaching reaction is run by adding sodium chlorite plus hydrogen peroxide and allowed to react until the trichomes and the specks are further reacted. The bleached trichomes may be recovered from the suspension.

In another aspect, trichomes are suspended with mixing in an aqueous solution, the solution is adjusted to an optimal pH and temperature, TAED and hydrogen peroxide are added and allowed to react to degrade trichome associated proteins of greater than 2,500 daltons.

In another aspect, trichomes are suspended with mixing in an aqueous solution, the solution is adjusted to an optimal pH and temperature, TAED and hydrogen peroxide are added and allowed to react to degrade trichome associated proteins of greater than 3,500 daltons.

In another aspect, trichomes are suspended with mixing in an aqueous solution, the solution is adjusted to an optimal pH and temperature, peracetic acid is added and allowed to react to degrade trichome associated proteins of greater than 2,500 daltons.

In another aspect, trichomes are suspended with mixing in an aqueous solution, the solution is adjusted to an optimal pH and temperature, peracetic acid is added and allowed to react to degrade trichome associated proteins of greater than 3,500 daltons.

In another aspect, trichomes are suspended with mixing in an aqueous solution, the solution is adjusted to an optimal pH and temperature, meta-Chloroperoxybenzoic acid is added and allowed to react to degrade trichome associated proteins of greater than 2,500 daltons.

In another aspect, trichomes are suspended with mixing in an aqueous solution, the solution is adjusted to an optimal pH and temperature, meta-Chloroperoxybenzoic acid is added and allowed to react to degrade trichome associated proteins of greater than 3,500 daltons.

In another aspect of the invention, the bleached individualized trichomes are removed from the suspension, separated from remaining non-trichome biomass and recovered.

Methods to accomplish this are known in the art and are not limited by those described herein. One method is to pass the suspension through a series of screens of decreasing pore size in which stems and undegraded biomass are retained on larger pore screens, whilst the trichomes pass through and are collected onto smaller pore screens. Other methods to remove stems are known such as the grape stem remover used in the wine industry

EXAMPLES

Example 1—Bleaching with TAED+Hydrogen Peroxide and Dithionite

For small scale testing, 50 mg of trichomes were distributed into 7.5 mL screw capped glass vials. Five mL of 25 mM sodium bicarbonate, pH 8.4 was added and heated to 45° C. until the trichomes were wetted. Taking into account the percent active in the powders and solutions, TAED or dithionate were added in the noted concentrations and the vials were shaken. Hydrogen peroxide was added last and the vials incubated at 45° C. with occasional shaking. Photographs of the vials were taken at about 2 h and 22 h (FIG. 1). Trichomes bleached with dithionite lightened, but turned a light tan. TAED+Hydrogen Peroxide yielded much lighter trichomes.

Example 2—Bleaching with Sodium Chlorite

Figure 2:
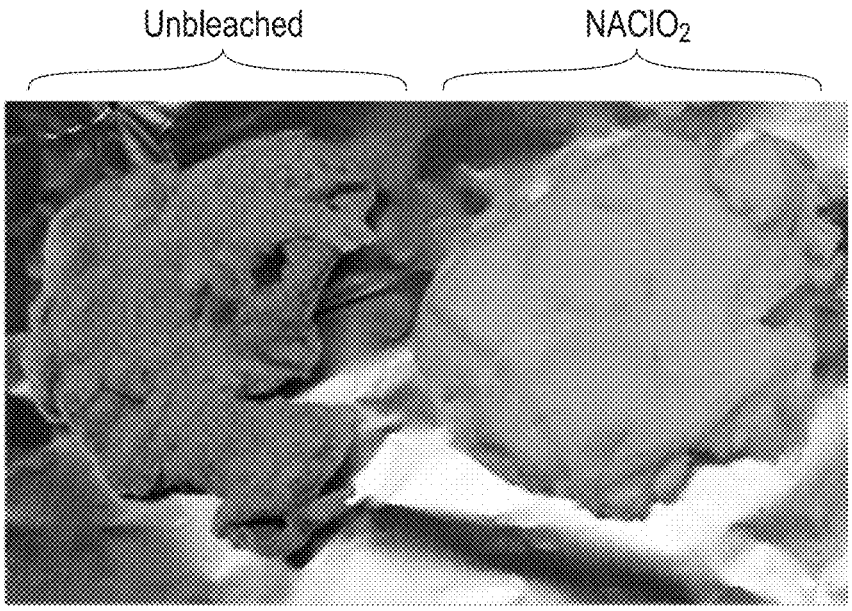
FIG. 2 is a comparison of unbleached and sodium chlorite reacted trichomes.

Dried trichomes (0.5 g each) were placed in two 50 mL conical tubes and 40 mL of 25 mM sodium citrate buffer, pH 4.5 was added. 50 mM sodium chlorite was added to one tube and the tubes were shaken and incubated at 31° C. for 45.5 h. The unbleached and bleached trichomes were vacuum filtered over a 0.22 um filter, washed with water, dried at 50° C. overnight, weighed and photographed (FIG. 2). After 24 h of incubation, the samples with $NaClO_2$ were lighter color than the non-treated control, but still tan. By 45.5 h, the treated samples were bright yellow. Upon filtering, most of the yellow color was washed away in the buffer, although the bleached trichomes still look slightly yellow to the eye. Brown specks present in the trichome preparation were bleached and not visible in the final sample.

Example 3—Bleaching Trichomes with Chlorite+Hydrogen Peroxide

Figure 3:
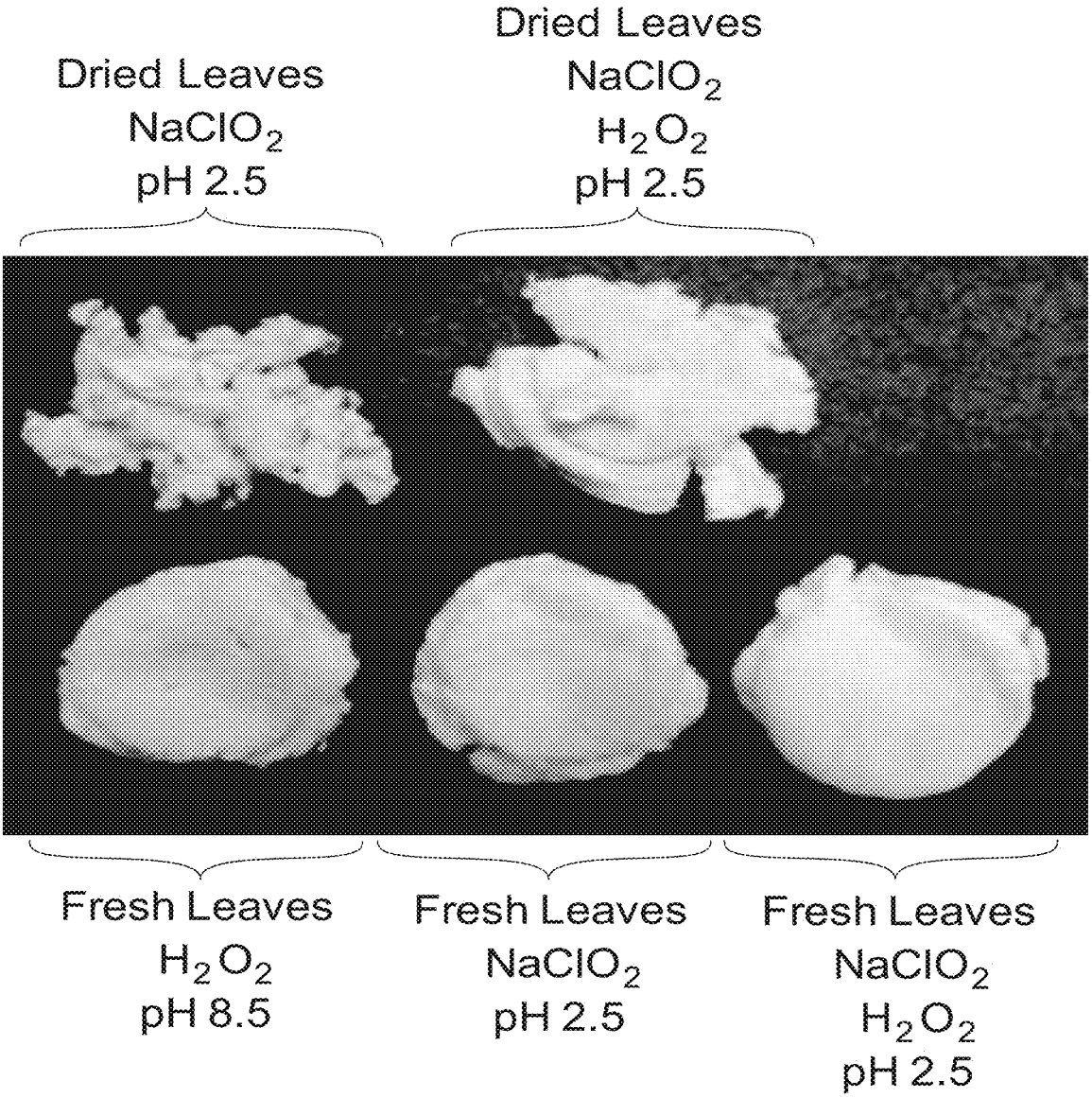
FIG. 3 is a comparison of sodium chlorite and sodium chlorite plus hydrogen peroxide bleached trichomes isolated from dry Lamb's Ear leaves, and hydrogen peroxide, sodium chlorite and sodium chlorite plus hydrogen peroxide bleached trichomes isolated from fresh Lamb's Ear leaves.

Trichomes (0.4 g) recovered from dried leaves and from fresh leaves were placed in 50 mL conical tubes. 40 mL of sodium citrate, pH 2.5 was added and treated with hydrogen peroxide, 40 mM sodium chlorite and/or 40 mM sodium chlorite+0.4 g Hydrogen Peroxide and incubated at 57° C. for 17 h. After incubation, the samples were vacuum filtered over a 0.22 um filter, washed with water, dried at 50° C. overnight and photographed (FIG. 3). Running the $NaClO_2$ bleaching at pH 2.5 sped up the reaction, which at 31° C. was complete at 5 h vs. 48 h at pH 4.5. Adding hydrogen peroxide to the $NaClO_2$ greatly reduced the yellow color.

Example 4—CIELAB Color Space Measurements of TAED Bleached Trichomes

A Konica Minolta CM-700d Spectrophotometer was used to measure color of trichomes. A MAV 8 mm target mask was placed onto the instrument's measuring port and the measurement area selector was set for MAV. SpectraMagic NX software was initiated and instrument settings were set to Reflectance, the Specular Component to SCE, and the Measurement Area to MAV (8 mm). Under Observer and Illuminant, Observer was set for 10 degrees, and the Primary set for D65. Sample Remote Measurement was activated. The instrument was calibrated for Black and for White. Pads of trichomes from the Corning sterilizing filter apparatus were dried, placed over a white background and the camera apparatus was placed directly onto the pad and the trigger on the instrument was pressed to obtain a measurement. Measurements were repeated to get three or four readings, then averaged.

Example 5—Color Measurements after Reacting Trichomes with Only TAED, Chlorite, Peracetic Acid or m-Chloroperoxybenzoic Acid Capped bottles were used to suspend 0.4-0.7 g of dried trichomes in 40-100 mL of 25 mM sodium bicarbonate, pH 8.4 at 57° C. until the trichomes were wetted. TAED and hydrogen peroxide were added and samples were reacted for another 8 h with occasional shaking. Trichomes were reacted with Chlorite for 17.5 h in 25 mM sodium citrate, pH 2.5. Trichomes were reacted with peracetic acid in 25 mM sodium bicarbonate and the pH was further adjusted to 8.4 using sodium hydroxide. Trichomes were reacted for 4 h with MCPB in 25 mM sodium bicarbonate, pH 8.4. All bleached trichomes were recovered on a 120 mesh sieve, washed with water, squeezed to remove excess water and suspended in 25 mM sodium citrate, pH 6.0. Samples were filtered onto a 250 mL Corning sterilizing filter bottle, collected and dried overnight at 31° C. After drying, color and lightness were measured as described in Example 4 (Table 1).

TABLE 1

Color change of individualized trichomes bleached with individual eactants

| Sample | TAED g/g | Peroxide g/g | Chlorite g/g | Peracetic Acid g/g | MCPB g/g | % Recovery | L* | a* | b* |
|---|---|---|---|---|---|---|---|---|---|
| 1 | 0 | 0 | 0 | 0 | 0 | 90.2 | 76.57 | 1.71 | 19.04 |
| 2 | 0.2 | .068 | 0 | 0 | 0 | 92.9 | 89.41 | −0.81 | 20.26 |
| 3 | 0.3 | .102 | 0 | 0 | 0 | 91.1 | 91.26 | −1.57 | 19.55 |
| 4 | 0.4 | .136 | 0 | 0 | 0 | 86.9 | 90.30 | −1.06 | 19.82 |
| 5 | 0.5 | .170 | 0 | 0 | 0 | 86.4 | 91.47 | −1.28 | 19.28 |
| 6 | 0 | 0.05 | 0.5 | 0 | 0 | 81.5 | 92.45 | 0.67 | 15.29 |
| 7 | 0 | 0 | 0 | 0.2 | 0 | 93.0 | 87.48 | −1.45 | 19.02 |
| 9 | 0 | 0 | 0 | 0 | 0.4 | 91.9 | 88.08 | 0.36 | 20.39 |

Bleaching with only TAED increased "L" by 14-15 points, decreased "a" from positive to negative, but did little to change the "b" value. Bleaching with only chlorite with hydrogen peroxide lowered the "a" value, increased "L" by 16 points, and decreased "b" by almost 4 points. When the 0.5 g/g chlorite/0.05 g/g peroxide treatment was done for 24 h, then a second addition of chlorite/peroxide was added and further reacted for another 24 h, an "L" value of 95, a "b" value of −1.6, and an "a" value of 9.15 were achieved. MCPB increased L* by 11.5 points, and b* increased by 1 point.

Example 6—Two-Step Bleaching Reactions with Chlorite and TAED, Chlorite and Peracetic Acid or Chlorite and MCPB Samples were treated for 17.5 h at 57° C. with sodium chlorite and hydrogen peroxide at pH 2.5. TAED or peracetic acid was added after sodium hydroxide addition to pH 8.4. More sodium hydroxide had to be added to the peracetic acid sample to bring the pH to 8.4. Samples were reacted for 5 h at 57° C., washed, harvested and their color measured (Table 2). By using the two-step process, less of each reactant is required to achieve more extensive bleaching than be each alone. Furthermore, brown speck impurities were bleached when sufficient sodium chlorite bleaching was performed.

TABLE 2

Two-Step bleaching reactions with Chlorite, then either TAED or Peracetic Acid.

| Sample # | Time Step 1→Step 2 | Chlorite g/g | TAED g/g | $H_2O_2$ g/g | Peracetic Acid g/g | % Weight Recovered | Specks | L | a | b |
|---|---|---|---|---|---|---|---|---|---|---|
| 1 | 17.5 h-5 h | 0.20 | 0.15 | 0.10 | 0 | 77.7 | ++ | 92.75 | −1.17 | 15.72 |
| 2 | 17.5 h-5 h | 0.22 | 0.15 | 0.10 | 0 | 80.8 | + | 93.11 | −1.35 | 16.11 |
| 3 | 17.5 h-5 h | 0.25 | 0.15 | 0.10 | 0 | 79.9 | ± | 93.70 | −1.81 | 15.93 |
| 4 | 17.5 h-5 h | 0.30 | 0.15 | 0.10 | 0 | 78.3 | ± | 93.51 | −0.83 | 15.40 |
| 5 | 17.5 h-5 h | 0.35 | 0.25 | 0.10 | 0 | 74.5 | ± | 94.05 | −1.80 | 14.68 |
| 6 | 17.5 h-5 h | 0.40 | 0.15 | 0.10 | 0 | 73.5 | − | 94.70 | −1.44 | 12.59 |
| 7 | 17.5 h-5 h | 0.45 | 0.15 | 0.10 | 0 | 73.7 | − | 94.95 | −1.36 | 12.21 |
| 8 | 17.5 h-5 h | 0.50 | 0.15 | 0.10 | 0 | 73.9 | − | 95.12 | −1.26 | 11.30 |
| 9 | 17.5 h-5 h | 0.25 | 0.15 | 0.05 | 0 | 81.5 | + | 92.47 | −1.09 | 17.06 |
| 10 | 17.5 h-5 h | 0.5 | 0 | 0.05 | 0.20 | 73.6 | − | 95.60 | −1.25 | 9.41 |

Figure 4:
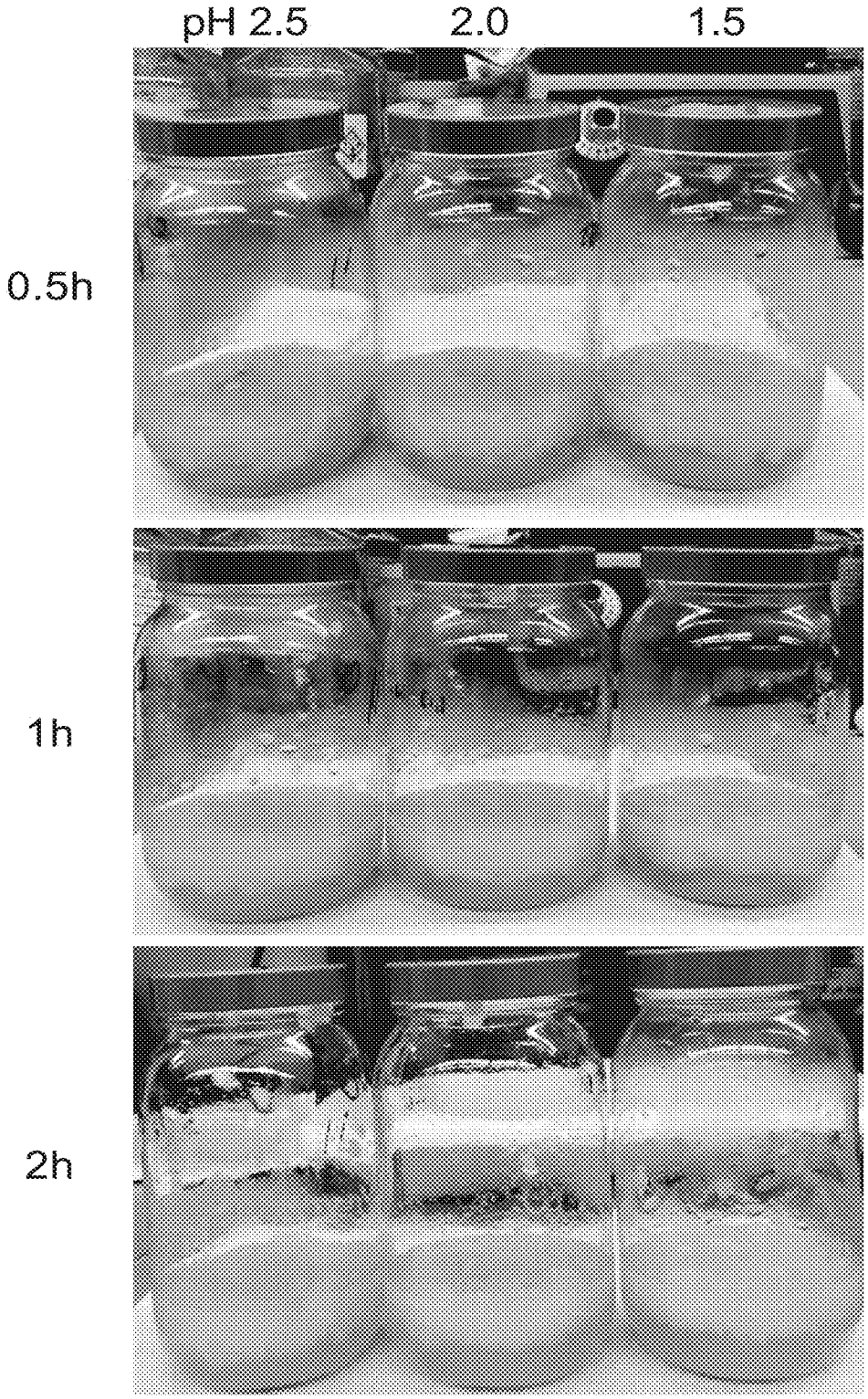
FIG. 4 is a photograph of trichomes suspended in 25 mM sodium citrate at pH 2.5, 2.0 and 1.5, exhibiting the differences in reaction to 0.4 g/g sodium chlorite plus 0.025 g/g hydrogen peroxide after 0.5 h, 1.0 h and 2.0 h.

It was further discovered that lowering the pH of the sodium chlorite and hydrogen reaction to 2.0 increased the rate of reaction (FIG. 4). In Table 3, the chlorite reaction was run with 0.025 g/g hydrogen peroxide for 2 h at 57° C., followed by the TAED reaction or the MCPB reaction at pH 8.4 for 2 h. When compared directly using 0.3 g/g chlorite in the first step and 0.3 g/g of the second step bleach, TAED had a higher L* value and slightly lower b* value, but MCPB exhibited similar performance.

TABLE 3

Two-Step bleaching reaction with Chlorite, then either TAED or MCPB

| Sample # | Chlorite g/g | TAED g/g | $H_2O_2$ g/g | MCPB g/g | % Weight Recovered | L | a | b |
|---|---|---|---|---|---|---|---|---|
| 1 | 0.1 | 0.3 | 0.10 | 0 | 86.5 | 93.37 | −2.31 | 18.00 |
| 2 | 0.2 | 0.3 | 0.10 | 0 | 81.1 | 93.26 | −2.71 | 19.16 |
| 3 | 0.3 | 0.3 | 0.10 | 0 | 76.6 | 94.74 | −2.68 | 15.00 |
| 4 | 0.4 | 0.3 | 0.10 | 0 | 79.2 | 95.18 | −2.52 | 12.46 |
| 5 | 0.3 | 0 | 0 | 0.1 | 77.9 | 92.71 | −1.46 | 16.98 |
| 6 | 0.3 | 0 | 0 | 0.2 | 82.2 | 93.23 | −2.25 | 16.70 |
| 7 | 0.3 | 0 | 0 | 0.3 | 80.0 | 93.64 | −2.19 | 15.47 |
| 8 | 0.3 | 0 | 0 | 0.4 | 84.8 | 94.14 | −2.48 | 15.32 |

Setting the chlorite reaction to 0.4 g/g fiber plus 0.025 g/g fiber hydrogen peroxide at pH 2.0 and 47° C. for 4 h, which is a sufficient amount and time to bleach all of the specks, the performance of peracetic acid and MCPB at a lower pH and lower temperatures was investigated (Table 4). For peracetic acid, pH 7.0 exhibited the same or improved L* and b* values except at 25° C. MCPB required the more alkaline pH of 8.4.

TABLE 4

| ° C. | pH | Time h | PAA g/g | MCPB g/g | % Recovery | L* | a* | b* |
|---|---|---|---|---|---|---|---|---|
| 57 | 8.4 | 4 > 2 | 0.517 | 0 | 73.4 | 95.89 | −2.14 | 9.70 |
| 57 | 7 | 4 > 2 | 0.517 | 0 | 70.1 | 96.02 | −2.08 | 9.07 |
| 47 | 8.4 | 4 > 2 | 0.517 | 0 | 83.2 | 94.90 | −2.22 | 12.39 |
| 47 | 7 | 4 > 2 | 0.517 | 0 | 75.4 | 94.81 | −2.17 | 11.83 |
| 37 | 8.4 | 4 > 2 | 0.517 | 0 | 82.0 | 94.26 | −1.88 | 14.40 |
| 37 | 7 | 4 > 2 | 0.517 | 0 | 79.7 | 94.26 | −0.94 | 14.21 |
| 25 | 8.4 | 4 > 2 | 0.517 | 0 | 79.5 | 93.11 | −1.25 | 16.22 |
| 25 | 7 | 4 > 2 | 0.517 | 0 | 81.4 | 92.38 | −1.09 | 16.96 |
| 47 | 8.4 | 4 > 2 | 0 | 0.59 | 73.8 | 95.08 | −1.58 | 9.67 |
| 47 | 7 | 4 > 2 | 0 | 0.59 | 72.0 | 93.86 | −1.24 | 12.47 |

U.S. Pat. No. 3,384,596 discloses that the equimolar addition of $Ca^{2+}$ to PAA, or $Mg^{2+}$ to MCPB increases their effectiveness. This was tested, along with seeing if the pH 8.4 is equal to pH 7.0 for PAA is repeatable, and how much PAA is required for effective whitening. Calcium chloride (1 g) was added to two of the PAA reactions, and 0.19 g of Magnesium Sulfate anhydrous was added to the MCPB reaction. Fibers were first bleached with sodium chlorite using 0.4 g/g+0.025 g/g Hydrogen Peroxide at 47° C. for 4 h. Calcium did not improve PAA bleaching. PAA at 0.463 g/g fiber bleached yielded the lowest b* value, but half as much PAA still worked well at pH 7.0, and all L* values were similar. Adding magnesium sulfate to the MCPB reaction improved both L* and b* values (Table 5).

TABLE 5

Levels of PAA and metals addition to PAA and MCPB

| PAA/ MCPB ° C. | pH | Time h | PAA g/g | MCPB g/g | % Recovery | L* | a* | b* |
|---|---|---|---|---|---|---|---|---|
| 47 | 8.4 | 4 > 2 | 0.463 | 0 | 75.8 | 94.96 | −2.13 | 12.34 |
| 47 + Ca | 8.4 | 4 > 2 | 0.463 | 0 | 75.4 | 92.77 | −0.94 | 14.72 |
| 47 | 7 | 4 > 2 | 0.463 | 0 | 76.9 | 94.37 | −2.04 | 13.83 |
| 47 + Ca | 7 | 4 > 2 | 0.463 | 0 | 72.8 | 91.89 | −0.91 | 15.92 |
| 57 | 7 | 4 > 2 | 0.463 | 0 | 74.8 | 95.78 | −2.23 | 9.27 |
| 57 | 7 | 4 > 2 | 0.348 | 0 | 73.9 | 95.63 | −2.24 | 10.34 |
| 57 | 7 | 4 > 2 | 0.232 | 0 | 78.6 | 95.80 | −2.23 | 10.54 |
| 57 | 7 | 4 > 2 | 0.116 | 0 | 77.5 | 94.99 | −2.32 | 13.53 |

TABLE 5-continued

Levels of PAA and metals addition to PAA and MCPB

| PAA/ MCPB ° C. | pH | Time h | PAA g/g | MCPB g/g | % Recovery | L* | a* | b* |
|---|---|---|---|---|---|---|---|---|
| 47 | 6.0 | 4 > 2 | 0.463 | 0 | 74.8 | 94.12 | −1.99 | 14.42 |
| 47 + Mg | 8.4 | 4 > 2 | 0 | 0.59 | 72.2 | 96.29 | −1.61 | 6.42 |

Table 6 determine how low a temperature and of concentration of MCPB can be used, and repeating the effect of magnesium sulfate. At 47° C., 0.30 g MCPB/g fiber exhibited good bleaching with magnesium sulfate present. This was improved more by reacting at 57° C., but 37° C. exhibited significant bleaching (Table 6).

TABLE 6

| ° C./Mg | pH | Time h | MCPB g/g | % Recovery | L* | a* | b* |
|---|---|---|---|---|---|---|---|
| 47 | 8.4 | 4 > 2 | 0.59 | 78.6 | 95.40 | −1.99 | 9.43 |
| 47 + 0.19 g Mg | 8.4 | 4 > 2 | 0.59 | 78.4 | 95.71 | −1.77 | 8.23 |
| 47 | 8.4 | 4 > 2 | 0.44 | 77.5 | 95.53 | −2.05 | 9.60 |
| 47 + 0.15 gMg | 8.4 | 4 > 2 | 0.44 | 76.6 | 95.53 | −1.81 | 8.24 |
| 47 | 8.4 | 4 > 2 | 0.30 | 76.9 | 95.19 | −2.26 | 10.37 |
| 47 + 0.10 g Mg | 8.4 | 4 > 2 | 0.30 | 73.8 | 95.71 | −2.06 | 9.34 |
| 47 | 8.4 | 4 > 2 | 0.15 | 78.0 | 94.45 | −1.93 | 13.45 |
| 47 + 0.05 g Mg | 8.4 | 4 > 2 | 0.15 | 75.9 | 94.16 | −1.90 | 13.41 |
| 57 + 0.10 g Mg | 8.4 | 4 > 2 | 0.30 | 73.3 | 95.87 | −2.09 | 8.35 |
| 37 + 0.10 g Mg | 8.4 | 4 > 2 | 0.30 | 71.7 | 95.15 | −2.08 | 10.31 |

Example 7—Large Scale Two Step-Bleaching of Trichomes

Individualized trichomes from two 250 gal enzyme process reactions were combined to give 4.9 kg of trichomes, added to 250 gallons of water in a 300 gal tank. 2 kg of citric acid was added, then hydrochloric acid to adjust the pH to 2.5. 6 kg of sodium chlorite and 4 L of 30% hydrogen peroxide (Chl) were added and the suspension was stirred for 19 h at 54° C. At 19 h, the pH was adjusted to 8.4 with 50% sodium hydroxide and 4 kg of TAED plus 4 L of 30% hydrogen peroxide were added. The suspension was stirred for 22.7 h. After the reaction, the pH had decreased to 4.9 and 50% sodium hydroxide was added to adjust the pH to 6.0. 1 g of Liquitint Violet CT was added and stirred for 2 h. The bleached trichomes were then harvested.

Figure 5A:
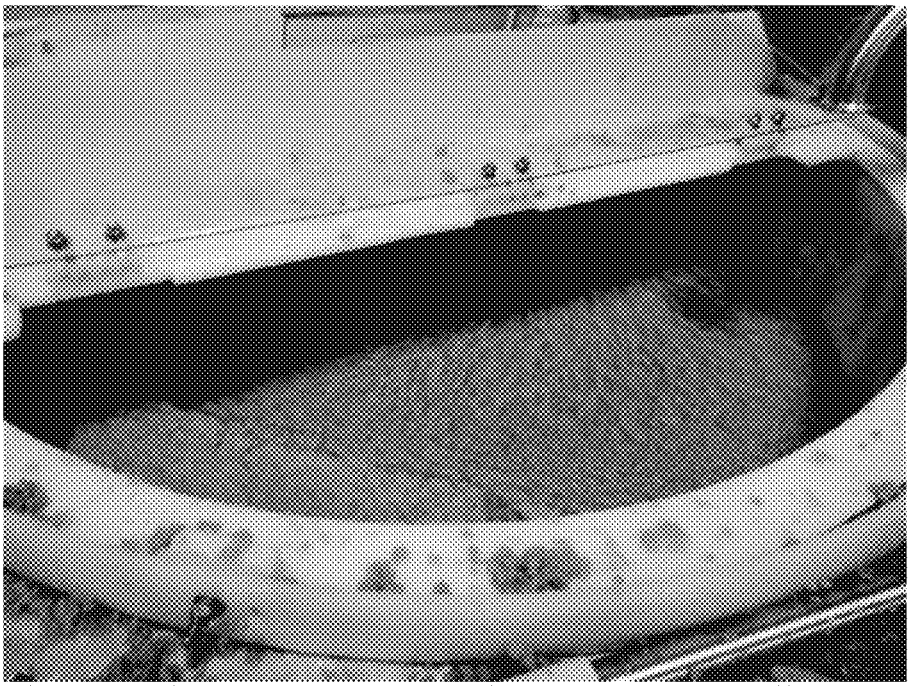
FIG. 5A is a photograph of 300 gallon mechanically individualized fiber suspension pre-bleaching.
Figure 5B:
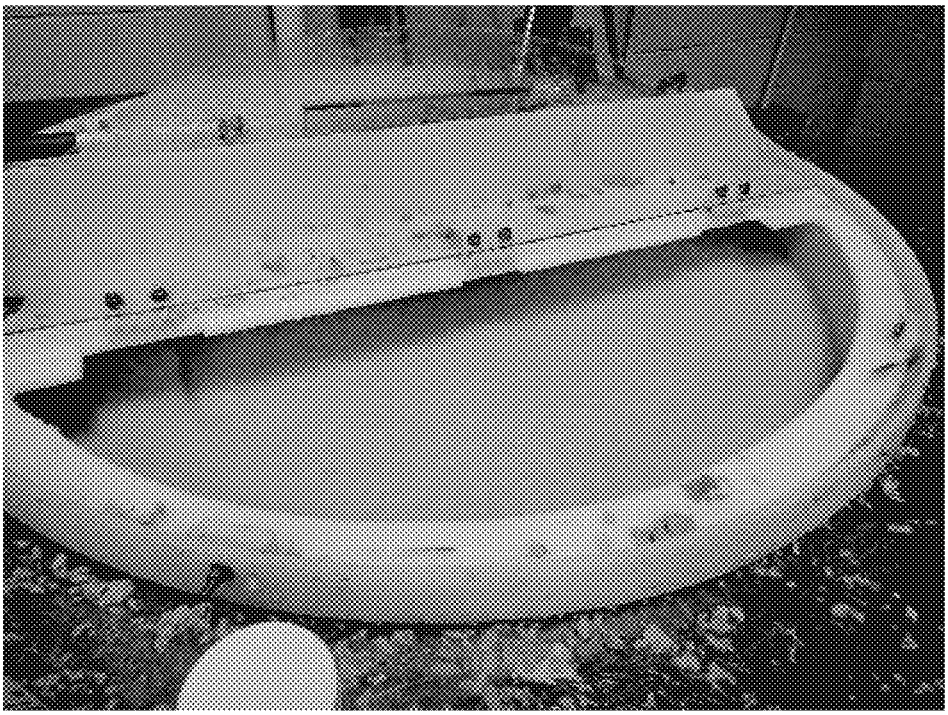
FIG. 5B is a photograph of 300 gallon mechanically individualized fiber suspension post bleaching with sodium chlorite plus hydrogen peroxide.
Figure 5C:
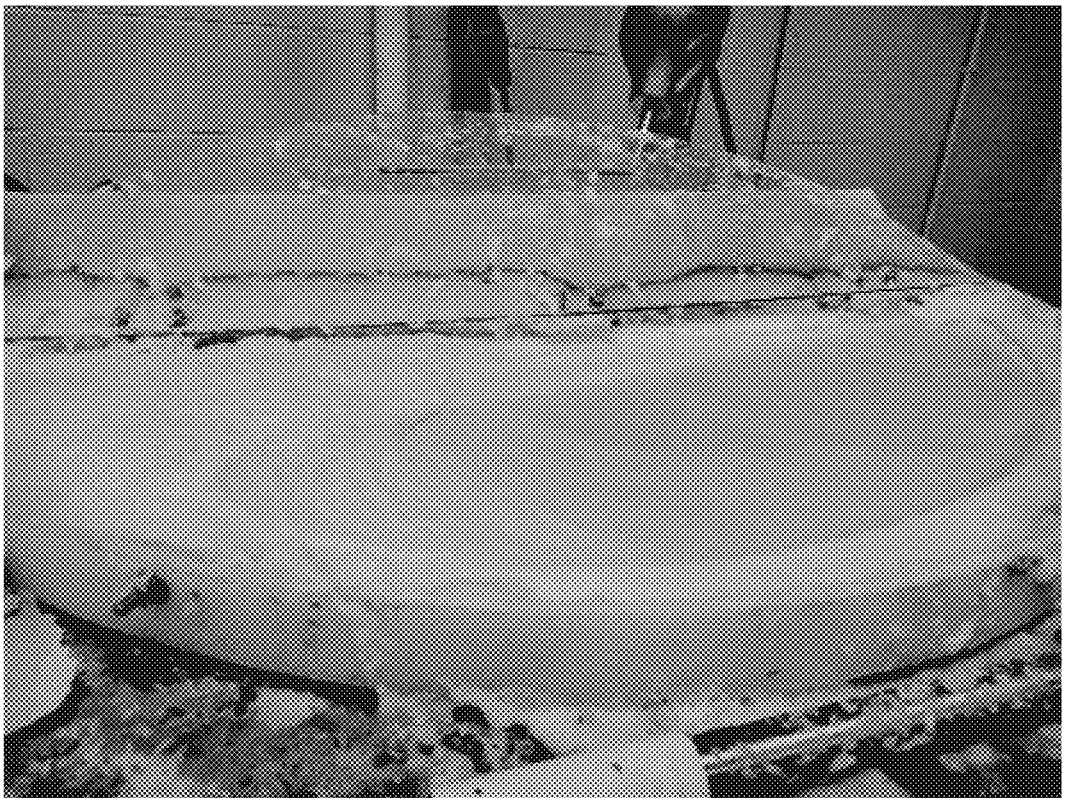
FIG. 5C is a photograph of 300 gallon chlorite bleached mechanically individualized fiber suspension post second step bleaching with TAED plus hydrogen peroxide.
Figure 6A:
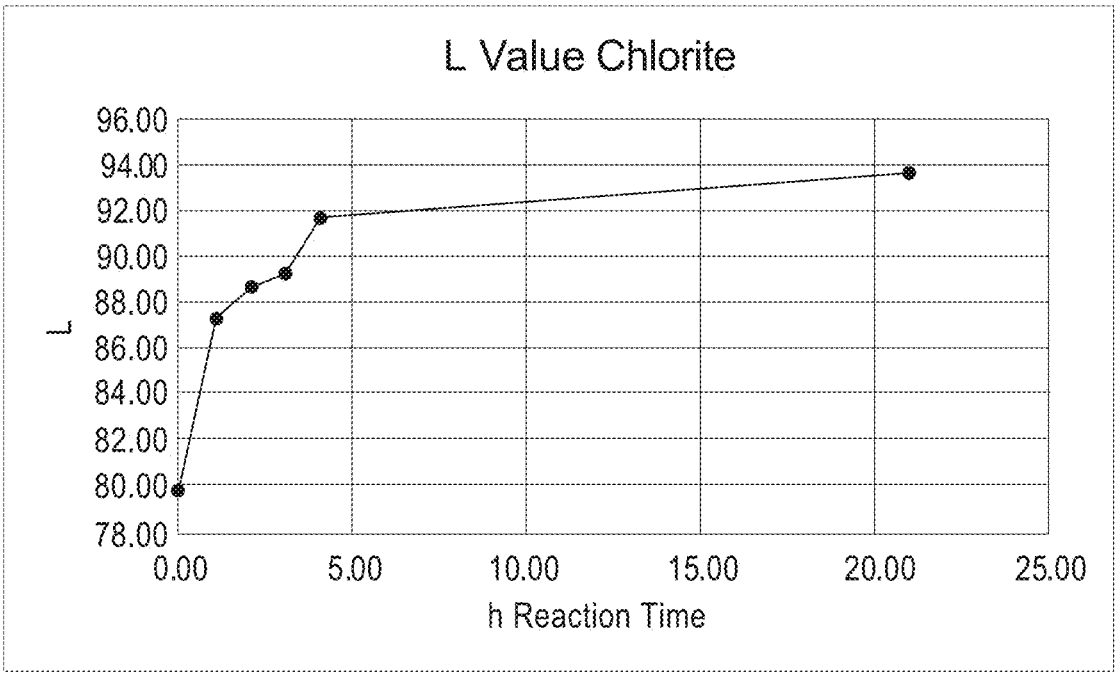
FIGS. 6A-6F are a collection of charts showing the trends of L*a*b measurements vs. time of sodium chlorite+hydrogen peroxide and TAED+hydrogen peroxide bleaching of trichomes in a stirred tank at the 250 gallon scale.
Figure 6B:
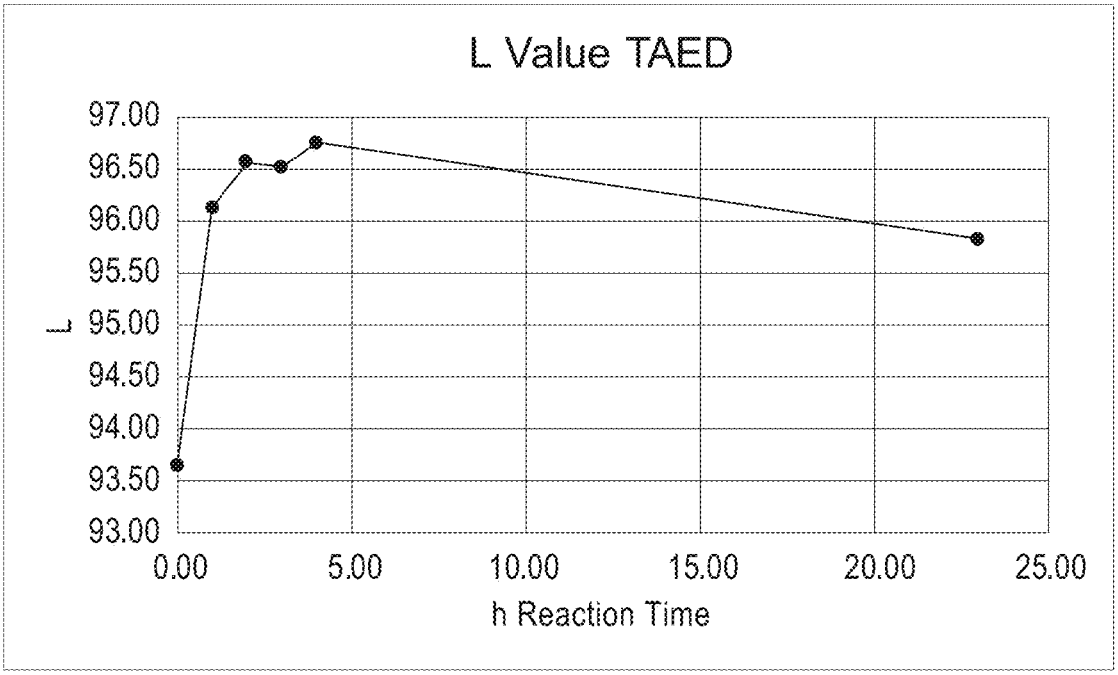
Figure 6C:
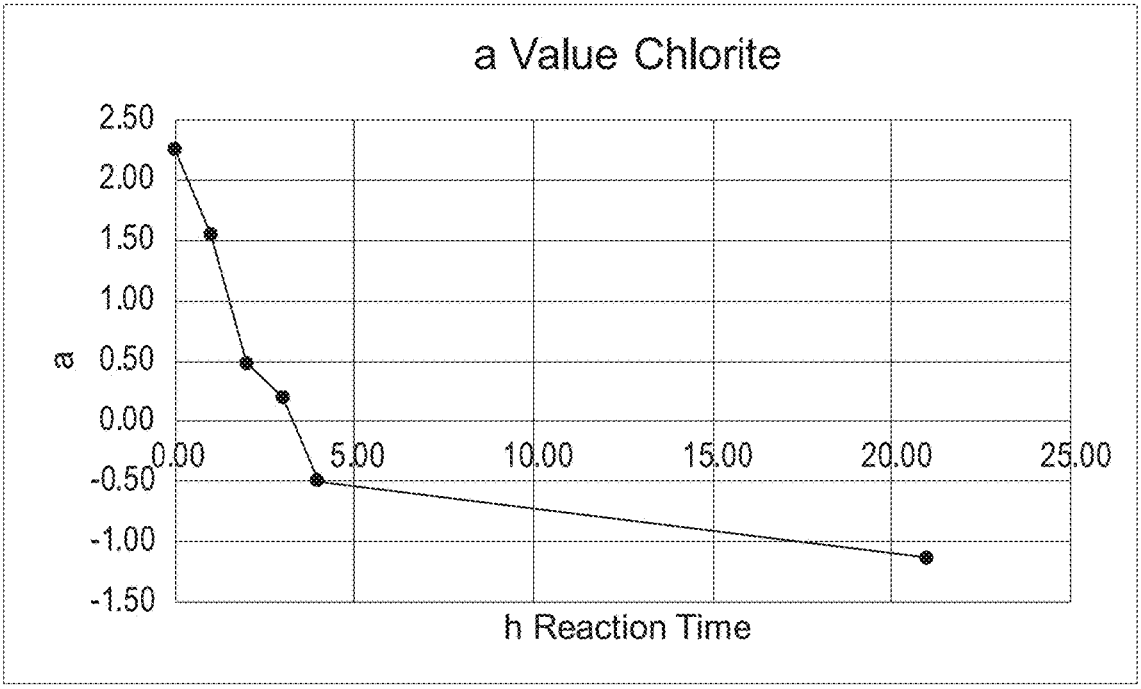
Figure 6D:
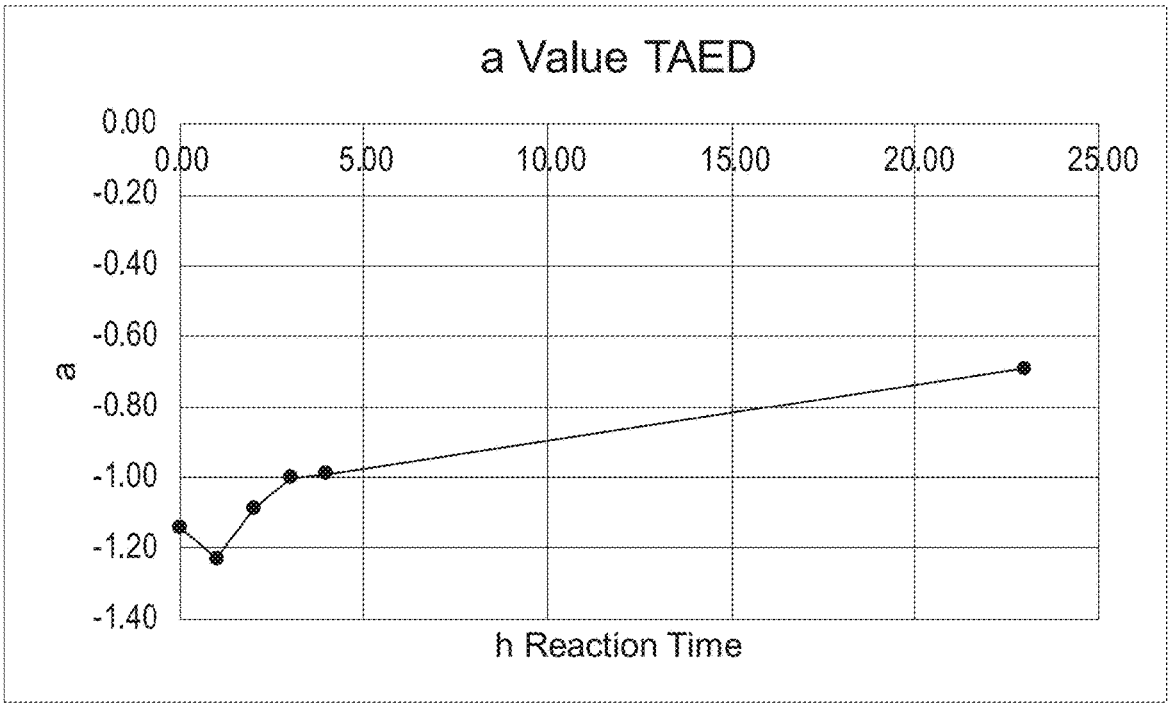
Figure 6E:
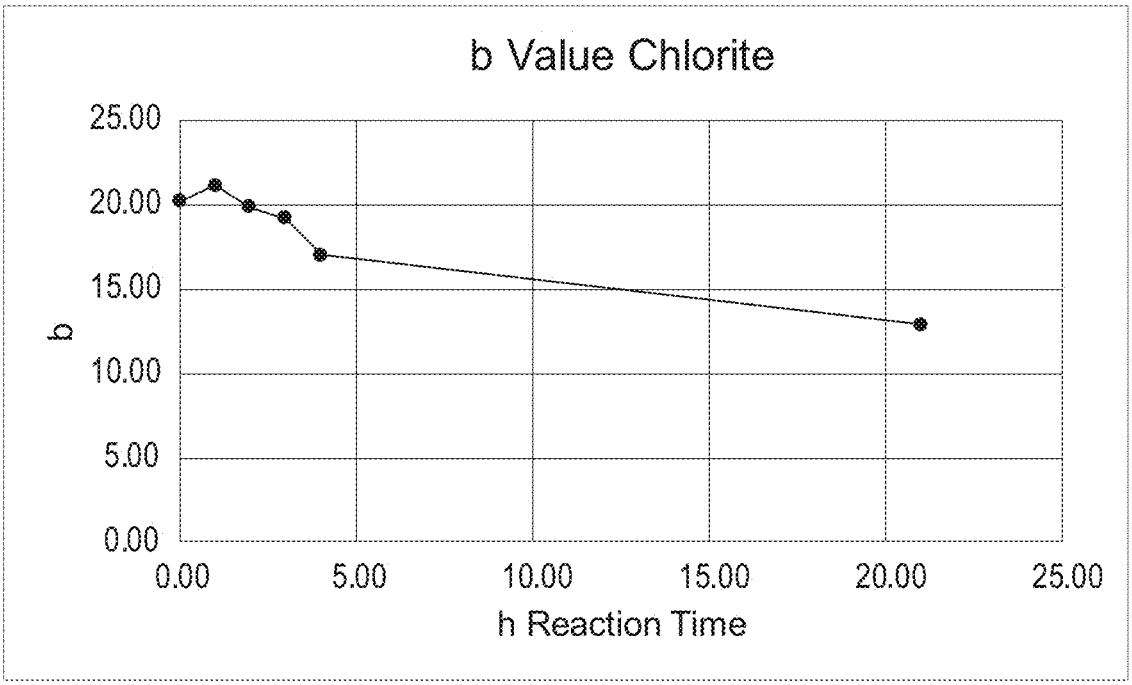
Figure 6F:
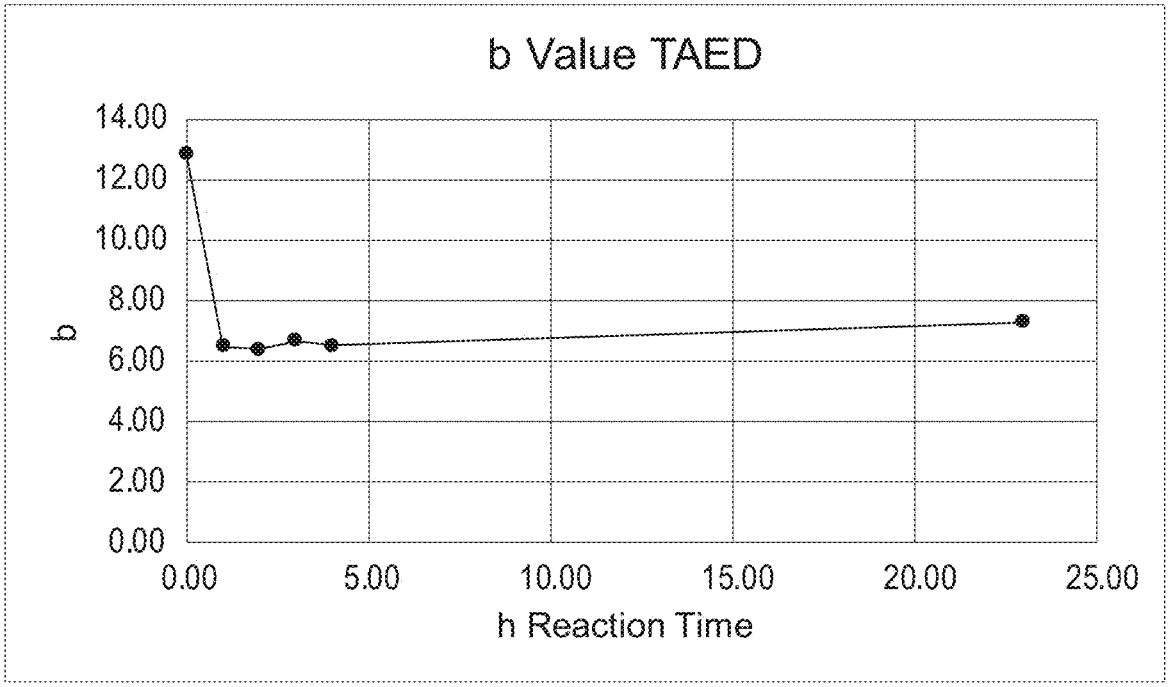

In a second experiment, 20 kg of individualized trichomes processed using the mechanical process disclosed in U.S. Pat. No. 8,808,501 were added to 250 gallons of water in a 300 gal tank, stirred for washing and recovered. The washed trichomes were added back to 250 gallons of water. 2 L of 30% hydrogen peroxide was added with 6 kg of sodium chlorite and reacted at 54° C. for 21 h. The pH was adjusted to 8.8 and 4 L of peroxide plus 4 kg of TAED were added. The pH immediately went down and sodium hydroxide was added to bring the pH to 8.5. At 1 h, the pH was 6.9 and was brought up to 9.5. The pH was checked every hour until 4 h where it was 8.3, so no more sodium hydroxide was required and the reaction proceeded for 22.75 h (FIG. 5) Individualized trichomes from the different steps of each run were sampled and processed for L*a*b* measurement. In addition, time points from the Mechanical trichomes bleaching were taken (Tables 7 and 8).

TABLE 7

Large Scale Enzymatic Process Individualized Trichome Bleach Data

| Sample | L | a | b |
|---|---|---|---|
| Starter | 82.12 | 1.91 | 18.85 |
| Chlorite | 89.09 | 0.16 | 19.92 |
| Chl–>TAED | 95.01 | −2.05 | 12.74 |
| Dyed | 92.69 | −2.13 | 9.78 |

TABLE 8

Large Scale Mechanically Individualized Trichome Bleach Data

| Sample | L | a | b |
|---|---|---|---|
| Starter | 79.81 | 2.25 | 20.23 |
| Chl 1 h | 87.30 | 1.55 | 21.15 |
| Chl 2 h | 88.69 | 0.48 | 19.85 |
| Chl 3 h | 89.27 | 0.20 | 19.23 |
| Chl 4 h | 91.71 | −0.50 | 17.01 |
| Chl 21 h | 93.65 | −1.14 | 12.90 |
| Chl–>TAED 1 h | 96.14 | −1.23 | 6.52 |
| Chl–>TAED 2 h | 96.57 | −1.09 | 6.41 |
| Chl–>TAED 3 h | 96.53 | −1.00 | 6.71 |
| Chl–>TAED 4 h | 96.76 | −0.99 | 6.53 |
| Chl–>TAED 23 h | 95.83 | −0.69 | 7.32 |

Results demonstrated that the bleaching reactions scaled up. The reactions also proceeded more quickly in a stirred tank reactor than what is observed when performed in an unstirred incubated jar with occasional mixing. The time points for the Mechanically individualized trichomes indicated that most of the sodium chlorite bleaching was complete by 4 h, although extending this reaction to 21 h improved the "L' value by 2 points and the "b" value by about 4 points. The TAED reaction was complete within 1-2 h with a 3 point increase in "L" and 6 point decrease in "b", demonstrating a greater response to "b" when reacted after sodium chlorite plus hydrogen peroxide bleaching. Extending the second step TAED reaction to 23 h resulted in a lower "L" and higher "b" (FIG. 6).

Example 8—Sodium Dodecyl Sulfate Gel Electrophoresis and Amino Acid Analysis

To extract the proteins from trichomes, 40 mg dried trichome fibers were placed in a 3 CC syringe. 1.5 ml of extraction buffer (4% Sodium Dodecyl Sulfate (SDS) in 150 mM Tris, pH 7.6) was added to the barrel of the syringe. With the syringe inverted, the plunger was inserted and air pressed out to the greatest extent possible. A 0.45 um nylon filter was placed on the end of the syringe and the apparatus was incubated 16 hours at 25° C. on a rocking platform. The extract was then pressed through the filter and collected in 1.5 ml microcentrifuge tubes. 600 ul of recovered extract was transferred to a NanoSep Omega 3K centrifugal concentrator (Pall) and centrifuged at 5,000×g for 2 hours. For each batch of test samples, one or more samples from fibers on which we obtained Amino Acid Analysis data were processed in parallel to act as a calibration point.

Sodium Dodecyl Sulfate Gel Electrophoresis (SDS-PAGE) samples were composed of 40 ul concentrated trichome extract, 10 ul 4× XT Sample Buffer (BioRad) and 2 ul 1 M Dithiothreitol. 50 ul of each sample was loaded onto a Criterion XT 4-12% Bis-Tris gel (BioRad). Ultra-Low MW marker (Sigma) and PrecisionPlus (BioRad) ladders for MW calibration were run. Gels were run at 100 V and stopped when the dye front reached the bottom edge. Gels were stained with colloidal blue (Invitrogen) and destained for at least 16 hours in reverse osmosis treated water.

Stained gels were scanned in a GelDoc EZ molecular imaging system (BioRad) using a default "coomassie" protocol using automatic exposure without automatic detection of lanes or bands. Lanes were manually selected. Bands were then defined as follows: a large "band" from the top of the gel immediately below the loading well down to approximately 10 kDa where the main staining "smear" ended. For samples with visible staining below 10 kDa, a second band was defined in this region. Background subtraction was disabled for all bands, as it is intended for more distinct localized staining than we observe for trichome. Instead, bands defined according to the criteria above were defined in an empty gel lane to generate a general background level.

Raw densitometry "volumes" (effectively integrated signal over the bands) were exported to Excel. Empty lane volumes were subtracted from the sample bands to correct for background signal. Total protein was then estimated using a single-point calibration based on the Amino Acid Analysis result from the control fiber sample. The equation used was: Estimated % protein=Sample densitometry volume*[(Control AAA % Protein)/(Control densitometry volume)].

To determine variance of the method, extractions were performed on triplicate samples of trichomes of two different protein levels (high and low). These were analyzed as described above and % C.V. was calculated to be 7.2% for the high protein trichomes and 8.6% for low protein trichomes. An extensive characterization of lower limit of detection has not been done, but based on visual examination of gel staining we estimate this value to be approximately 0.1% protein. Several trichome fiber samples return densitometry values at or below this level, in which case they are equivalent to background signal.

Amino Acid Analysis as performed by the Molecular Structure Facility (MSF), Proteomics Core University of California at Davis. The standard analysis for all the amino acids except cysteine, methionine and tryptophan are as follows:

A. Transfer noted mass to glass hydrolysis tube.
B. Dry the sample.
C. Perform liquid phase hydrolysis (6N HCL, 1% Phenol, 110° C., 24 hr, in vacuo).
D. Cool, unseal, dry sample.
E. Dissolve in the sample solution buffer
F. Sodium Diluent (Pickering, 40 nmol/mL NorLeucine added)
G. Load a 50 μL sample injection onto the ion-exchange column.

Standards and Calibration

1. An amino acid standards solution for protein hydrolysate on the Na-based Hitachi 8800 (Sigma, A-9906) is used to determine response factors, and thus calibrate the Hitachi 8800 analyzer for all the amino acids. In addition, this standard has been verified against the National Institute of Standards and Technology (NIST) standard reference material 2389a.
2. Each injection contains norleucine as an internal standard to allow correction of the results for variations in sample volume and chromatography variables.
3. System utilizes Pickering Na buffers and a Transgenomic Ion-Exchange column with a secondary reaction with ninhydrin for detection and an optimized method developed by MSF
4. Data is reviewed my two staff members for accuracy

Figure 7A:
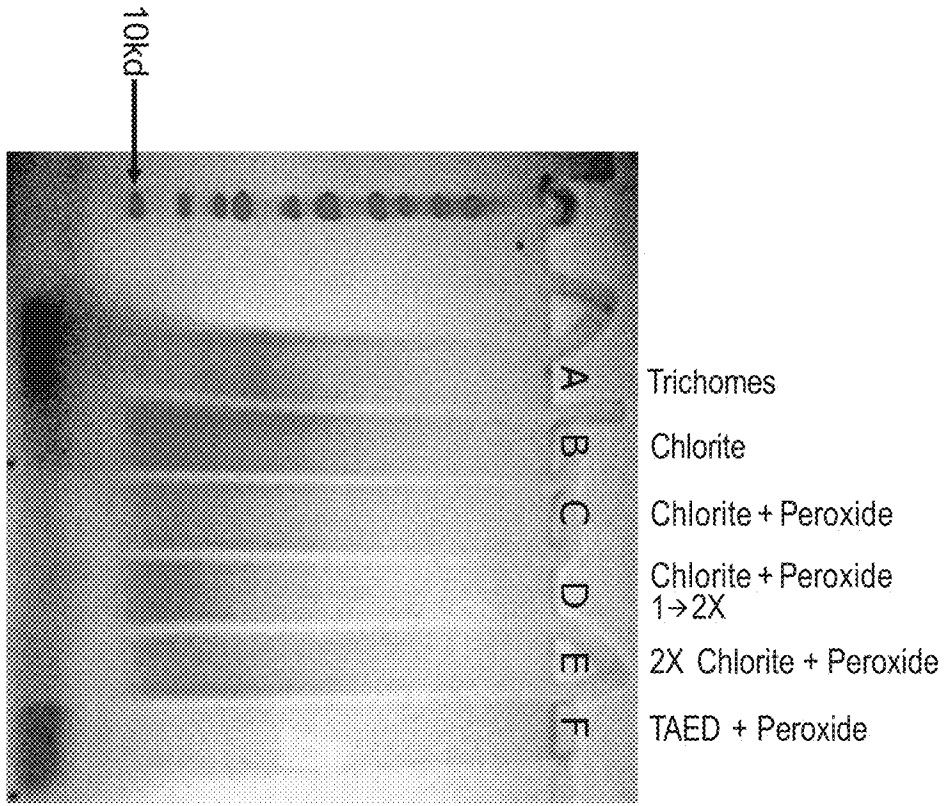
FIG. 7A is a Sodium Dodecyl Sulfate Gel Electrophoresis (SDS-PAGE) analysis of extracted trichome associated proteins pre- and post-bleaching with sodium chlorite, sodium chlorite plus hydrogen peroxide and TAED plus hydrogen peroxide.
Figure 7B:
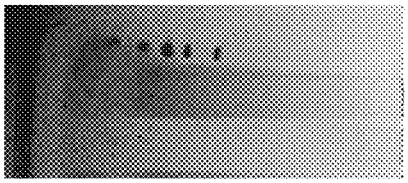
FIG. 7B is an SDS-PAGE analysis of extracted trichome associated proteins pre- and post-bleaching with peracetic acid.
Figure 7C:
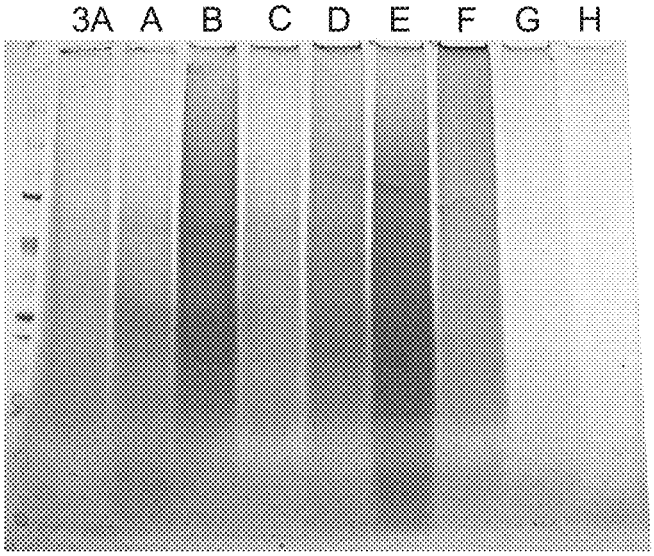
FIG. 7C is an SDS-PAGE analysis of extracted acid individualized trichome associated proteins, and from fibers bleached with sodium chlorite, sodium chlorite then TAED plus hydrogen peroxide, and with m-Chloroperoxybenzoic acid.

Example 9—Bleaching with TAED/Peracetic Acid and MCPB Decreases Levels of Trichome Associated Proteins Mechanically, enzymatically or acid individualized trichomes contain 1.0-3.5% protein by weight depending on the source of Lamb's Ear and the process used to individualize them. Individualized trichomes enzymatically processed from dry Lamb's Ear leaves were subjected to bleaching reactions at 57° C. and analyzed by SDS-PAGE (FIG. 7A). Lane A is fiber; Lane B was reacted for 20 h with 0.5 g/g sodium chlorite; Lane C was reacted for 20 h with 0.5 g/g sodium chlorite and 0.5 g/g hydrogen peroxide; Lane D was treated as Lane C with an additional 0.5 g/g of sodium chlorite and hydrogen peroxide added at 20 h and reacted a further 24 h; Lane E was reacted for 44 h with 1.0 g/g sodium chlorite and 1.0 g/g hydrogen peroxide; and Lane F was reacted for 20 h with 0.57 g/g TAED and 0.5 g/g hydrogen peroxide. Sodium chlorite bleaching with or without peroxide appears to remove most of a large stained band of low molecular weight running near the front of the gel. The TAED plus hydrogen peroxide appears to remove much of the higher molecular weight proteins above 10 kd. Since the product of TAED plus hydrogen peroxide is peracetic acid, individualized trichomes were bleached with peracetic acid and the high molecular weight proteins were degraded (FIG. 7B). Trichomes reacted with 0.4 g MCPB/g fiber exhibited extensive loss of both higher and lower molecular weight protein (FIG. 7C—lane H). It is surprising that only certain bleaching reactants, and even selected peroxy bleach molecules, efficiently degraded large molecular weight proteins. Experiments with Oxone (Potassium peroxymonosulfate) demonstrated that it is less efficient in degrading the proteins.

Densitometry measurements of the peracetic acid treated sample indicated the level of protein of 3,000 Da or higher was 0.04% by weight. Another two-step bleach reaction using 0.5 g/g sodium chlorite, 0.1 g/g hydrogen peroxide and 0.15 g/g TAED indicated 0.02% higher molecular weight protein.

Figure 7D:
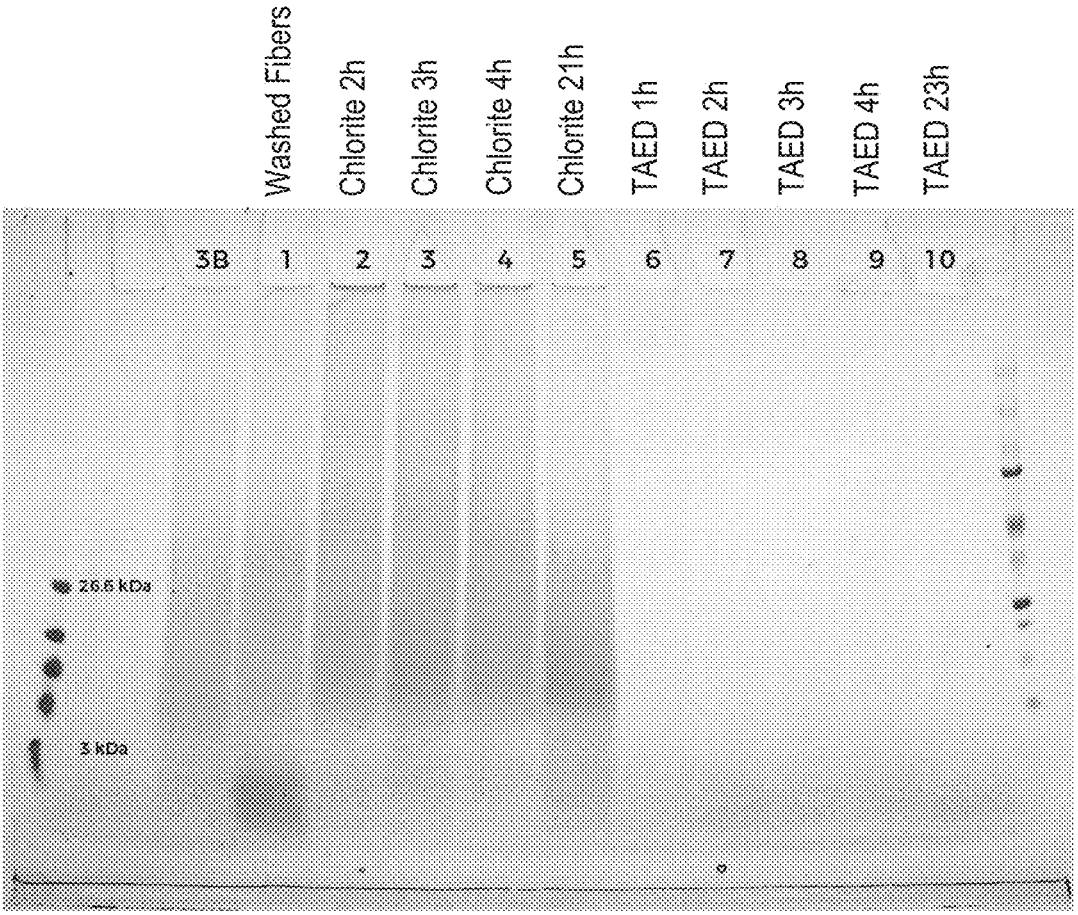
FIG. 7D is an SDS-PAGE analysis of extracted trichome associated proteins of samples from the 300 gal Mechanically derived trichome bleaching reactions.

FIG. 7D is an SDS-PAGE of the 300 gallon bleaching reaction on mechanically individualized trichomes described in Example 7. The sodium chlorite/hydrogen peroxide step 1 reaction removes a broad low molecular weight band. The TAED reaction degrades the higher molecular protein within the first hour of reaction. Total amino acid analysis of selected samples demonstrates that, using the described conditions, the sodium chlorite reaction does not deplete the total amino acids. However, the TAED reaction degraded approximately ⅔ of the amino acids, reflection protein degradation and removal (Table 9).

TABLE 9

Amino Acid Analysis of Large Scale Bleached Mechanically Individualized Trichomes

| Sample ID | Description | AAA % protein |
|---|---|---|
| T1 | Starting material | 1.06 |
| T4 | 4 h chlorite | 1.25 |

TABLE 9-continued

| Amino Acid Analysis of Large Scale Bleached Mechanically Individualized Trichomes | | |
|---|---|---|
| Sample ID | Description | AAA % protein |
| T6 | 1 h TAED | 0.35 |
| T7 | 2 h TAED | 0.35 |

The foregoing description is given for clearness of understanding only, and no unnecessary limitations should be understood therefrom, as modifications within the scope of the invention may be apparent to those having ordinary skill in the art.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process of treating individualized trichomes to remove proteins, whereby the process comprises:

a. selecting a trichome containing biomass, b. individualizing the trichomes from the biomass, wherein the trichomes have a protein content, c. wetting the trichomes, d. reacting the trichomes with a reactant comprising a peracid and a peracid activator, e. removing the trichomes from the reaction, and f. measuring the protein content of the reacted trichomes wherein protein present in the individualized trichomes is reacted with the reactant to break down the protein via oxidation, yielding individualized trichomes with less than 0.1% protein by weight of molecular weight greater than 3,500 daltons.

2. The process of claim 1 wherein the peracid is peracetic acid.

3. The process of claim 2 wherein peracetic acid is generated by reacting N,N,N',N'-Tetraacetylethylenediamine with hydrogen peroxide.

4. The process of claim 1 wherein the temperature of the reacting step d is maintained above 20° C.

5. The process of claim 1 wherein the pH of the reacting step d is maintained above 5.0.

6. The process of claim 1 wherein the reaction of the reacting step d is for greater than 1 minute.

7. The process of claim 1 wherein the biomass is from *Stachys byzantina.*

8. The process of claim 1 wherein the biomass is from *Stachys byzantina.*

9. A process of treating individualized trichomes to remove proteins, whereby the process comprises:

a. selecting a trichome containing biomass, b. individualizing the trichomes from the biomass, wherein the trichomes have a protein content, c. wetting the trichomes, d. reacting the trichomes with a first reactant, e. reacting the trichomes with a second reactant, f. removing the trichomes from the second reaction, and g. measuring the protein content of the reacted trichomes wherein at least one of the first and second reactants comprise a peracid and a peracid activator, and wherein the individualized trichomes have Hunter Color values of L* greater than 87 and b* less than 17, and wherein protein present in the individualized trichomes is reacted with the first and second reactants so as to break down the protein via oxidation, yielding individualized trichomes with less than 0.1% protein by weight of molecular weight greater than 3,500 daltons.

10. The process of claim 9 wherein the trichomes are removed from the first reaction before reacting with the second reactant.

11. The process of claim 9 wherein the peracid is peracetic acid.

12. The process of claim 9 wherein the peracetic acid is generated by reacting N,N,N',N'-Tetraacetylethylenediamine with hydrogen peroxide.

13. The process of claim 9 wherein the first reactant, the second reactant, or both reactants comprise sodium chlorite.

14. The process of claim 13 wherein hydrogen peroxide is included in the reaction.

15. The process of claim 14 wherein the temperature is maintained above 20° C.

16. The process of claim 9 wherein the biomass is from *Stachys byzantina.*

* * * * *